US009989225B2

(12) United States Patent
Rao et al.

(10) Patent No.: US 9,989,225 B2
(45) **Date of Patent: *Jun. 5, 2018**

(54) SYSTEM CONFIGURED FOR MOUNTING WITH A CEILING SUPPORT GRID AND METHOD OF INSTALLATION

(71) Applicant: Litetronics International, Inc., Bedford Park, IL (US)

(72) Inventors: Raghu Rao, Romeoville, IL (US); Robert Sorensen, Bedford Park, IL (US)

(73) Assignee: Litetronics International, Inc., Bedford Park, IL (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/614,155

(22) Filed: Jun. 5, 2017

(65) Prior Publication Data

US 2017/0356632 A1 Dec. 14, 2017

Related U.S. Application Data

(63) Continuation-in-part of application No. 15/181,171, filed on Jun. 13, 2016, now Pat. No. 9,897,288, and a continuation-in-part of application No. 15/590,553, filed on May 9, 2017, which is a continuation-in-part of application No. 15/368,541, filed on Dec. 2, 2016, now Pat. No. 9,671,095.

(51) Int. Cl.

| | |
|---|---|
| ***F21V 21/04*** | (2006.01) |
| ***E04B 9/00*** | (2006.01) |
| ***F21V 23/00*** | (2015.01) |
| ***F21V 21/30*** | (2006.01) |

(52) U.S. Cl.

CPC ..... *F21V 21/048* (2013.01); *E04B 9/003* (2013.01); *E04B 9/006* (2013.01); *F21V 21/046* (2013.01); *F21V 23/003* (2013.01); *F21V 21/30* (2013.01)

(58) Field of Classification Search

CPC .. E04B 9/08; E04B 9/006; E04B 9/205; F21S 8/026; F21V 21/048; F21V 23/003; F21V 21/046; F21V 21/30

See application file for complete search history.

(56) References Cited

U.S. PATENT DOCUMENTS

| | | | | | |
|---|---|---|---|---|---|
| 2,852,663 | A * | 9/1958 | Stuffer | F21V 17/101 | 292/145 |
| 2,961,530 | A * | 11/1960 | Garnett | F21S 8/02 | 362/311.03 |
| 3,019,333 | A * | 1/1962 | Pascucci | F21S 8/02 | 220/3.8 |
| 3,308,288 | A * | 3/1967 | Ades | E04B 9/006 | 362/150 |

(Continued)

*Primary Examiner* — Rodney Mintz

(74) *Attorney, Agent, or Firm* — Witters & Associates; Steve Witters

(57) ABSTRACT

Technologies are described for a system for mounting a louver, a lens, or a rectangular or square light LED light source to a ceiling support grid. A mounting frame has at least one fixed flat extension extending from the first side and at least one retractable extension on a second side. The mounting frame is configured to be inserted into a grid opening and mounted to the grid and provide a frame for the mounting of a louver, a lens, or a rectangular or square light LED light source to the ceiling support grid.

19 Claims, 16 Drawing Sheets

(56) References Cited

U.S. PATENT DOCUMENTS 3,545,145 A * 12/1970 Yousefpor ..... E04B 9/003 362/150
3,810,085 A * 5/1974 Woloski ..... F21S 8/02 362/277
3,816,880 A * 6/1974 Jacobs ..... E04B 9/006 362/150
4,041,657 A * 8/1977 Schuplin ..... E04B 9/006 248/343
4,171,535 A * 10/1979 Westermann ..... F21S 8/02 362/148
4,188,656 A * 2/1980 Howard ..... E04B 9/006 362/365
4,613,929 A * 9/1986 Totten ..... F21S 8/02 362/148
4,967,324 A * 10/1990 Barclay ..... F21V 21/04 362/147
5,044,103 A * 9/1991 Izenberg ..... G09F 7/18 40/611.06
5,564,815 A * 10/1996 Littman ..... F21S 8/028 362/147
5,997,158 A * 12/1999 Fischer ..... F21S 8/04 362/364
6,059,424 A * 5/2000 Kotloff ..... F21V 17/107 362/220
6,231,213 B1 * 5/2001 Schmidt ..... F21S 8/02 362/374
7,413,323 B2 * 8/2008 Lippis ..... E04B 9/0478 362/147
7,611,257 B2 * 11/2009 Engel ..... F21S 8/02 362/147
8,042,977 B1 * 10/2011 Nourishad ..... F21S 2/005 362/217.05
8,083,369 B1 * 12/2011 Richardson ..... F21S 8/026 362/217.11
8,393,765 B2 * 3/2013 Sugishita ..... F21S 8/026 362/147
8,556,453 B1 * 10/2013 Crane ..... F21S 8/026 362/217.01
8,764,216 B2 * 7/2014 Caferro ..... F21V 29/004 362/148
8,783,896 B2 * 7/2014 Tirrell ..... E04B 9/006 362/220
8,888,313 B2 * 11/2014 Green ..... F21V 17/18 362/217.11
8,894,232 B2 * 11/2014 Caferro ..... F21V 29/004 362/148
9,206,948 B1 * 12/2015 Scribante ..... F21V 21/03
9,279,553 B1 * 3/2016 Scribante ..... F21S 8/026
9,353,923 B2 * 5/2016 Scribante ..... F21S 8/022
9,488,348 B2 * 11/2016 Scribante ..... F21S 8/026
9,494,286 B2 * 11/2016 Green ..... F21V 17/18
9,551,482 B2 * 1/2017 Seward ..... F21V 17/18
9,671,095 B1 * 6/2017 Sorensen ..... F21V 21/042
9,803,815 B2 * 10/2017 Cousin ..... F21S 8/043
9,835,307 B1 * 12/2017 Blair ..... F21V 3/02
2009/0196024 A1 * 8/2009 Heiking ..... F21S 8/026 362/150
2010/0142202 A1 * 6/2010 Sugishita ..... F21S 8/026 362/235
2011/0103042 A1 * 5/2011 Tirrell ..... E04B 9/006 362/147
2013/0027915 A1 * 1/2013 Caferro ..... F21V 29/004 362/147
2013/0027916 A1 * 1/2013 Caferro ..... F21V 29/004 362/147
2013/0223100 A1 * 8/2013 Caferro ..... F21V 29/004 362/612
2013/0235568 A1 * 9/2013 Green ..... F21V 17/18 362/218
2014/0146542 A1 * 5/2014 Seward ..... F21V 23/026 362/297
2014/0340883 A1 * 11/2014 Green ..... F21V 17/18 362/220
2015/0267873 A1 * 9/2015 Price ..... F21V 21/03 362/235
2015/0276125 A1 * 10/2015 Pratt ..... F21S 2/005 362/217.15
2016/0084447 A1 * 3/2016 Scribante ..... F21V 21/03 362/223
2016/0091158 A1 * 3/2016 Scribante ..... F21S 8/026 362/223
2016/0091181 A1 * 3/2016 Scribante ..... F21S 8/026 362/220
2016/0102825 A1 * 4/2016 Scribante ..... F21S 8/022 362/217.12
2016/0116136 A1 * 4/2016 Bernard ..... F21V 15/01 362/150
2016/0281941 A1 * 9/2016 Cousin ..... E04B 9/0478
2016/0356430 A1 * 12/2016 Stratas ..... F21S 8/04
2016/0356432 A1 * 12/2016 Scribante ..... F21V 21/03
2016/0377238 A1 * 12/2016 Scribante ..... F21V 21/03 362/223
2017/0038044 A1 * 2/2017 Matsuda ..... F21S 8/061
2017/0051900 A1 * 2/2017 Scribante ..... F21S 8/026
2017/0059101 A1 * 3/2017 Green ..... F21V 17/18
2017/0114970 A1 * 4/2017 Scribante ..... F21S 8/026
2017/0130938 A1 * 5/2017 Seward ..... F21V 17/002
2017/0205036 A1 * 7/2017 Sorensen ..... F21S 8/026
2017/0356625 A1 * 12/2017 Sorensen ..... F21V 11/02
2018/0010746 A1 * 1/2018 Li ..... F21S 8/026
2018/0017218 A1 * 1/2018 Ham ..... F21K 9/278

* cited by examiner

SYSTEM CONFIGURED FOR MOUNTING WITH A CEILING SUPPORT GRID AND METHOD OF INSTALLATION

CROSS-REFERENCE TO RELATED APPLICATIONS

This application is a continuation in part of co-pending U.S. patent application Ser. No. 15/181,171, entitled "Removable Louver or Lens Holder for A Ceiling Support Grid and Method of Use", filed Jun. 13, 2016. This application is also a continuation in part of co-pending U.S. patent application Ser. No. 15/590,553, entitled "Led Light Panel and Method of Installation", filed May 9, 2017, which is a continuation in part of co-pending U.S. patent application Ser. No. 15/368,541, entitled "Lighting System Configured for Mounting With A Ceiling Support Grid and Method of Installation", filed Dec. 22, 2016 and issuing as U.S. Pat. No. 9,671,095. The above-referenced patent applications are incorporated herein by reference in their entirety, for all purposes.

FIELD OF THE DISCLOSURE

This invention generally relates to a system for mounting to a ceiling support grid, such as a louver, lens, or lighting system.

BACKGROUND

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Ceiling support grids and ceiling panels are very common in the office buildings where ceilings are constructed over open floor plan interior designs, such as cubicles. Such ceiling are popular in other commercial, industrial and domestic environments, including and not limited to hotels, meeting rooms, recreation rooms and other types of rooms or constructions which require removable ceilings for access to utilities (heating, air conditioning, water) that are concealed in the space between the drop ceiling tiles and the structural ceiling of the room. Such ceiling systems are well suited for use in old office buildings with high ceilings and with ceilings that are curved or arched. Typically, ceiling panels may be installed from beneath the ceiling support grid.

Typical luminaires installed in ceiling support grids may have a troffer with one or more tube lamps held therein. The luminaire may be placed on the ceiling support grid to have the light from the lamps directed downward through a space in the ceiling support grid having a ceiling panel removed. A lens, such as a diffusing lens or diffuser, or louver may be placed about the light opening in the ceiling support grid.

It is often desired to place, replace, or retrofit light sources, louvers, or lenses on a ceiling support grid.

SUMMARY

In at least one embodiment of the present disclosure, a lighting system configured to be mounted with a ceiling support grid is provided. The ceiling support grid having at least one rectangular or square grid opening with a first longitudinal flange extending inward from a first side and a second longitudinal flange extending inward from a second side, wherein the first flange and the second flange are parallel with one another. A rectangular or square mounting frame configured to be mounted in the rectangular or square grid opening, the mounting frame comprising: a first side, a second side, a third side, and a fourth side, wherein each of the sides are joined at terminal ends to form the rectangular or square mounting frame; a corner support extending between two of the joined sides of the mounting frame; at least one fixed flat extension extending out from the first side of the mounting frame; at least one retractable extension configured and disposed to extend out from the second side the mounting frame, wherein the first side of the mounting frame and the second side of the mounting frame are parallel; a rectangular or square LED light source configured to be held to the mounting frame, the LED light source comprising: at least one extension extending beyond a first side: at least one clasp on a second side, wherein the first side and the second side are parallel; the at least one extension being configured to hold the first side of the LED light source with one of the sides of the mounting frame; and the at least one clasp being configured to clasp with the side of the mounting frame and hold the LED light source to the mounting frame.

In at least one other embodiment of the present disclosure, a system for mounting a louver, a lens, or a rectangular or square light LED light source to a ceiling support grid is provided. The ceiling support grid has at least one rectangular or square grid opening with a first flange extending inward from a first side and a second flange extending inward from a second side, the system comprising: a rectangular or square mounting frame configured for mounting a louver, a lens, or a rectangular or square light LED light source to the ceiling support grid, the mounting frame comprising: a first side, a second side, a third side, and a fourth side, wherein the sides are joined at terminal ends, forming corners of the mounting frame, the first side and the second side are parallel with one another; at least one fixed flat extension extending from the first side and in a plane parallel with a plane of the mounting frame, each of the fixed flat extensions having a width proximate the first side greater than or equal to a width proximate a terminal end thereof and being configured and disposed to lay on the first flange of the ceiling support grid and removably hold the first side with the ceiling support grid; at least one retractable extension configured to have a portion extended from the second side and in a plane parallel with the plane of the mounting frame, and retracted into the second side; wherein the at least retractable extension is configured for passing the mounting frame into the ceiling support grid, through the at least one rectangular or square grid opening, upon the at least one fixed flat extension being laid on the first flange of the ceiling support grid and the at least one retractable extension being in the retracted position; and wherein the at least one retractable extension is configured for holding the mounting frame with the ceiling support grid upon the at least one fixed flat extension being laid on the first flange of the ceiling support grid and the at least one retractable extension being in the extended position and laid on the second flange of the ceiling support grid.

In at least one additional embodiment of the present disclosure, a method of installing a frame in a ceiling support grid is provided. The method comprises the steps of: inserting at least one fixed flat extension, extending from a first side of the frame, into a ceiling support grid opening and resting the at least one fixed flat extension on the ceiling support grid; pivoting the frame about the at least one fixed flat extension and placing it substantially within a plane of the ceiling support grid; extending at least one retractable support outwardly from a second side of the frame and resting the at least one retractable support on the ceiling support grid, and thereby holding the frame with the ceiling support grid; wherein the first side of the frame is parallel with the second side of the frame.

BRIEF DESCRIPTIONS OF THE DRAWINGS

The foregoing and other features of this disclosure will become more fully apparent from the following description and appended claims, taken in conjunction with the accompanying drawings and examples. Understanding that these drawings depict only several embodiments in accordance with the disclosure and are, therefore, not to be considered limiting of its scope, the disclosure will be described with additional specificity and detail through use of the following figures, which are idealized, are not to scale and are intended to be merely illustrative of aspects of the present disclosure and non-limiting. In the drawings, like elements are depicted by like reference numerals. The drawings are briefly described as follows:

Figure 8:
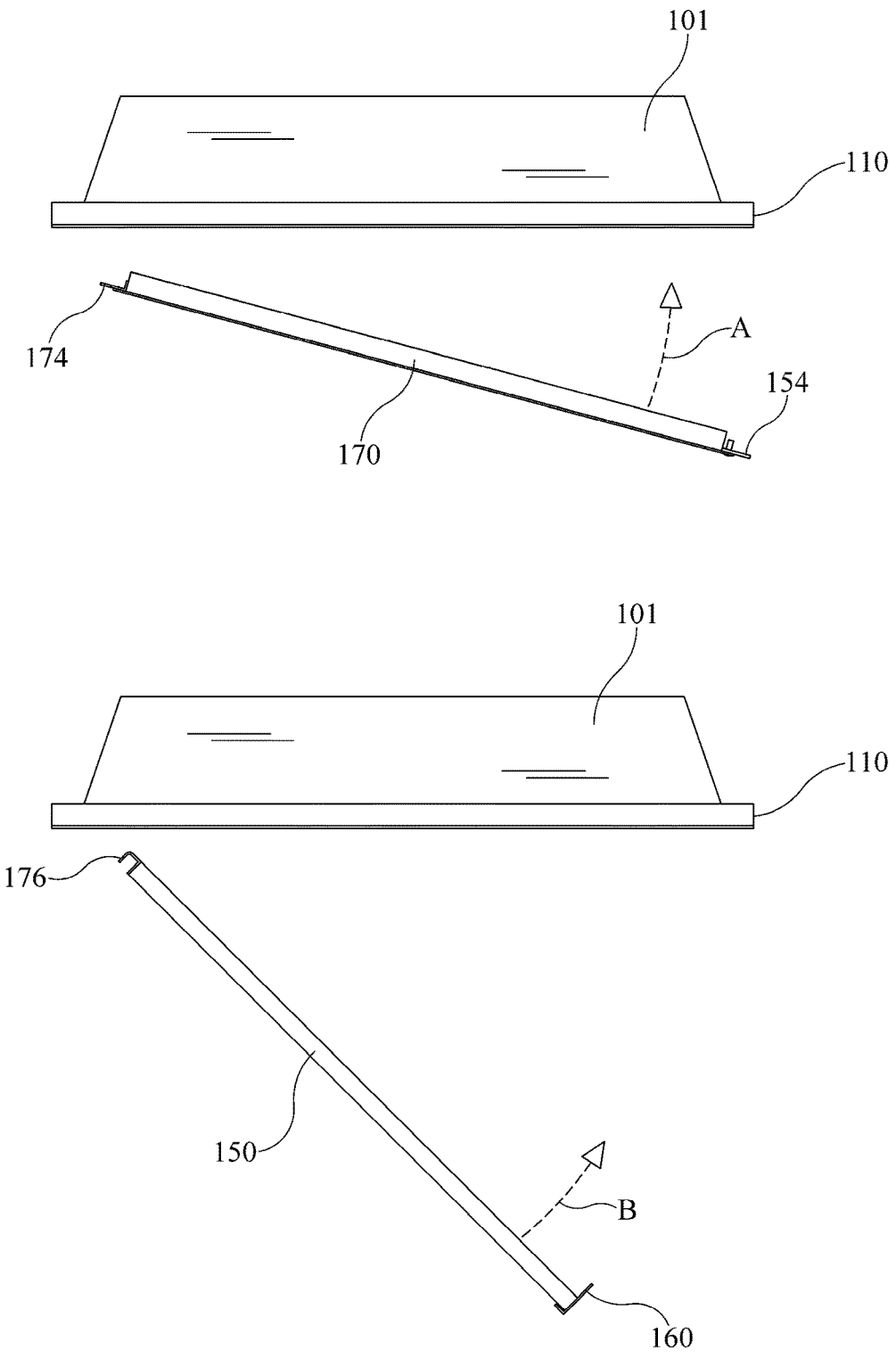
Figure 9:
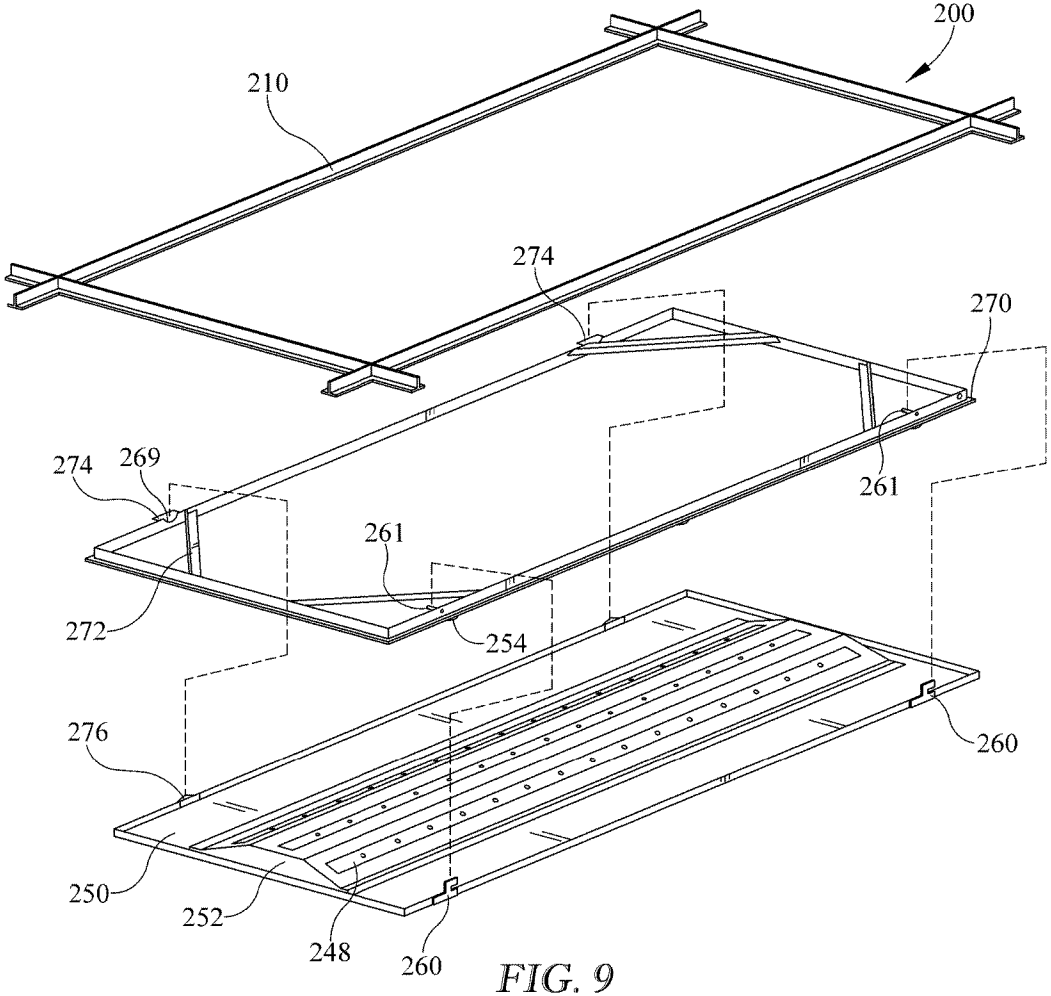
Figure 10:
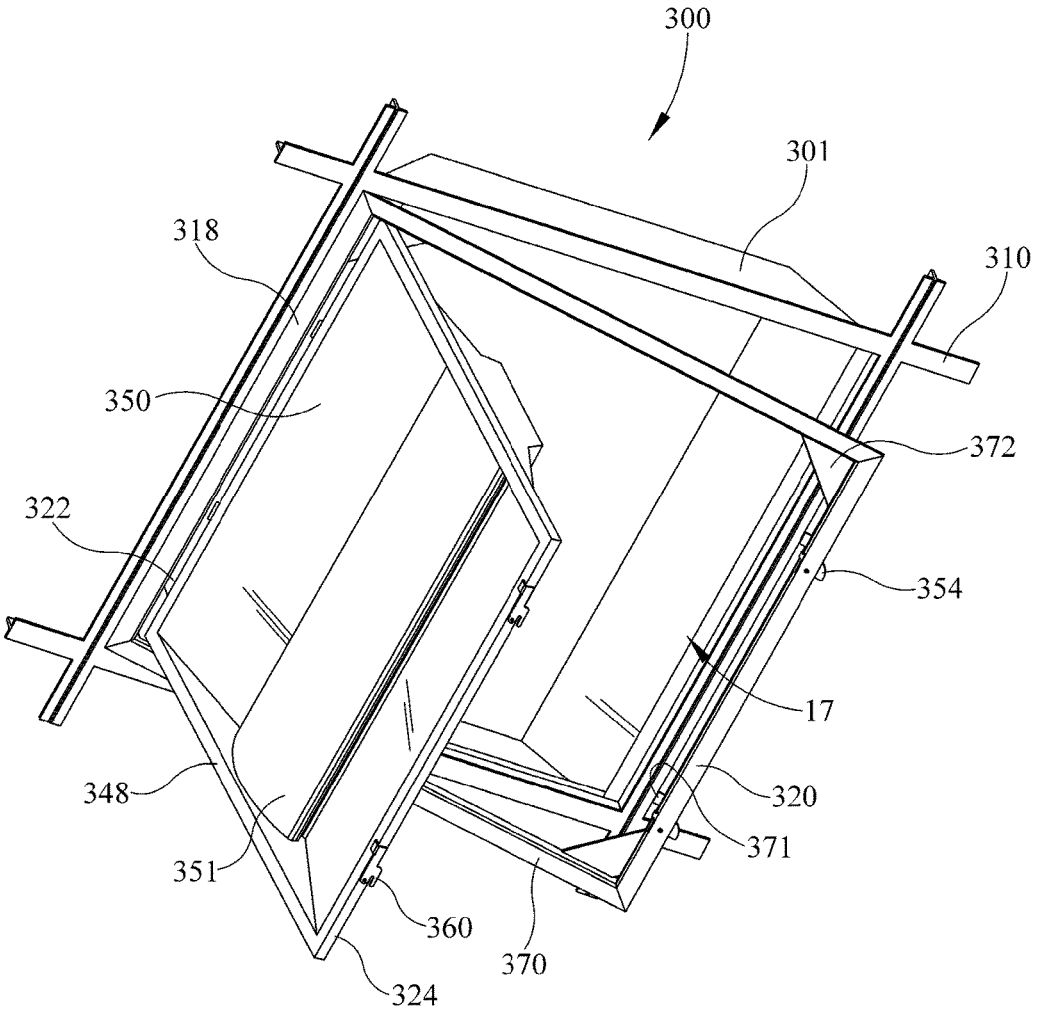
Figure 11:
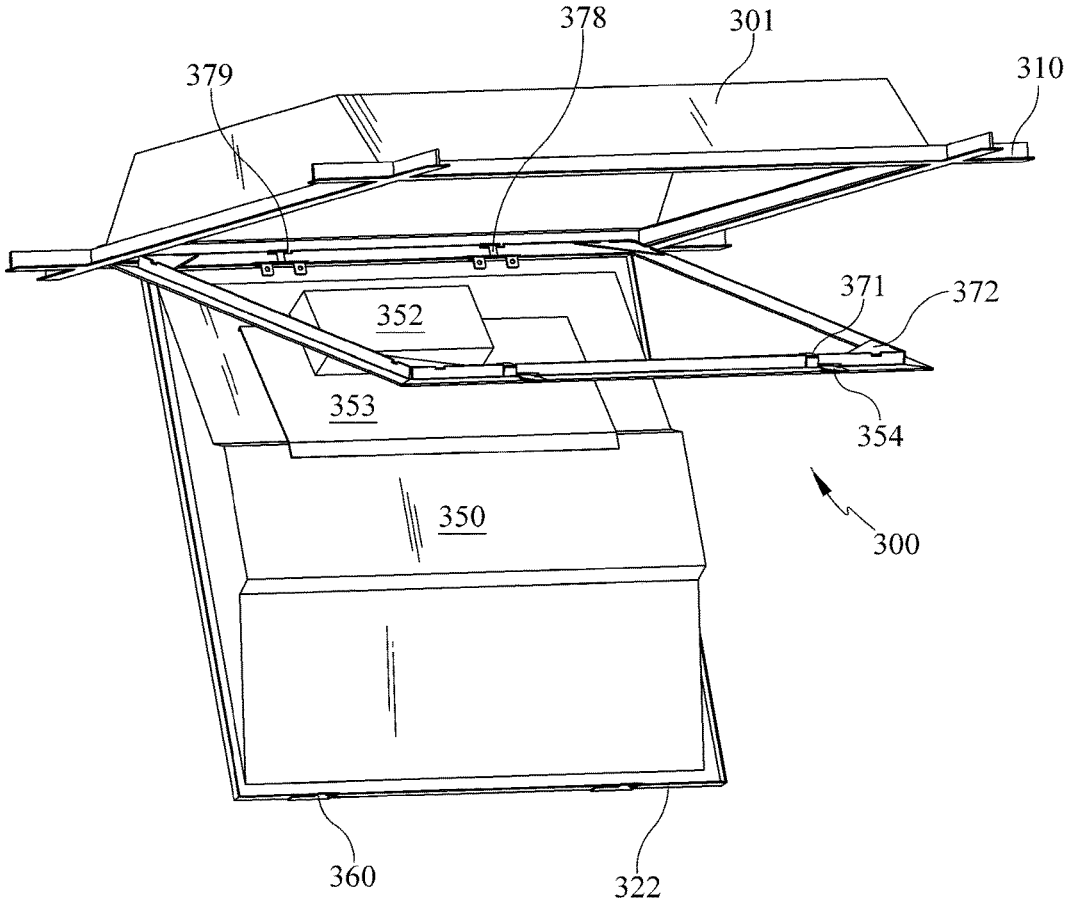
Figure 12:
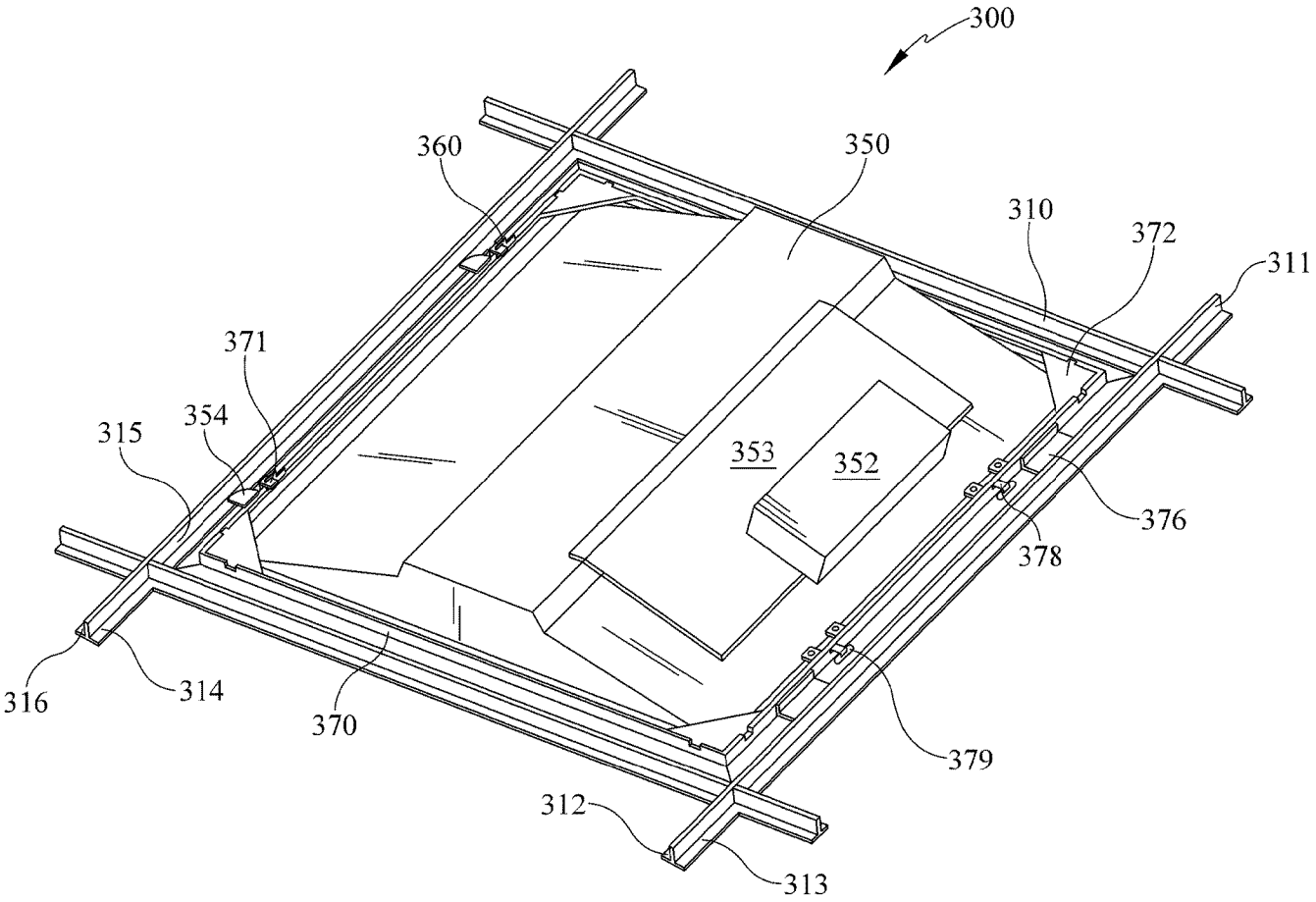
Figure 13:
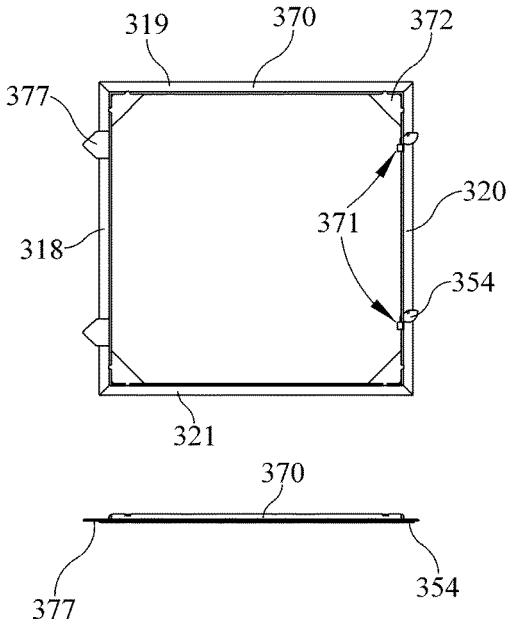
Figure 14:
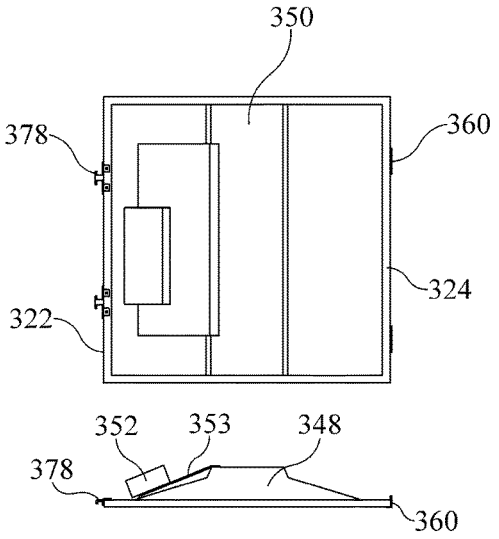
Figure 15:
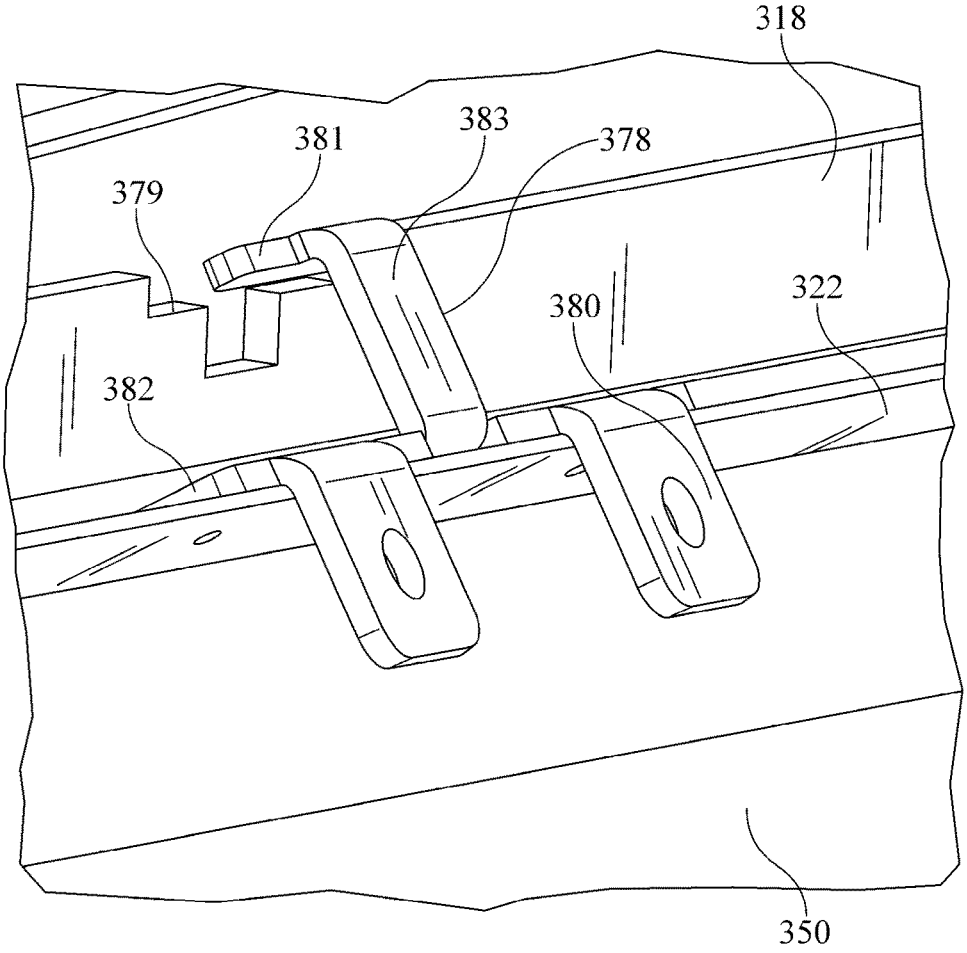
Figure 16A:
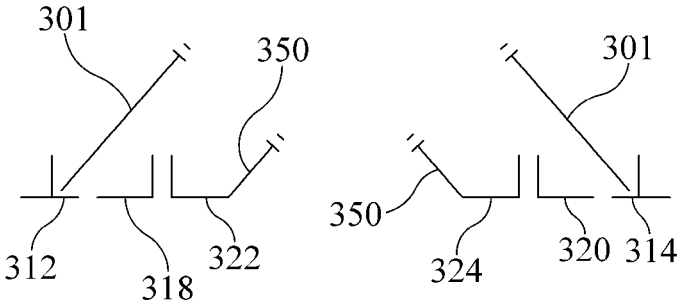
Figure 16B:
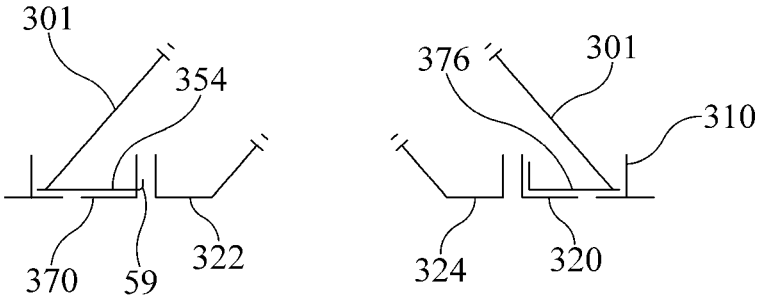
Figure 16C:
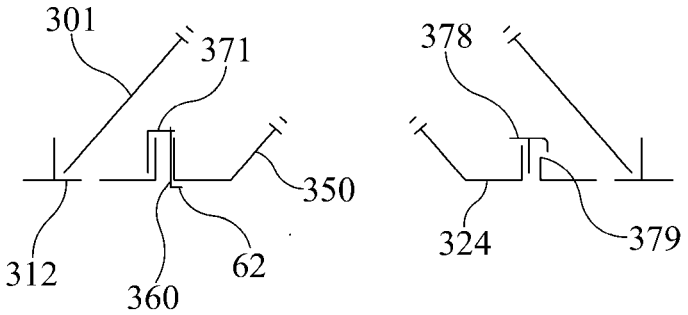
Figure 17:
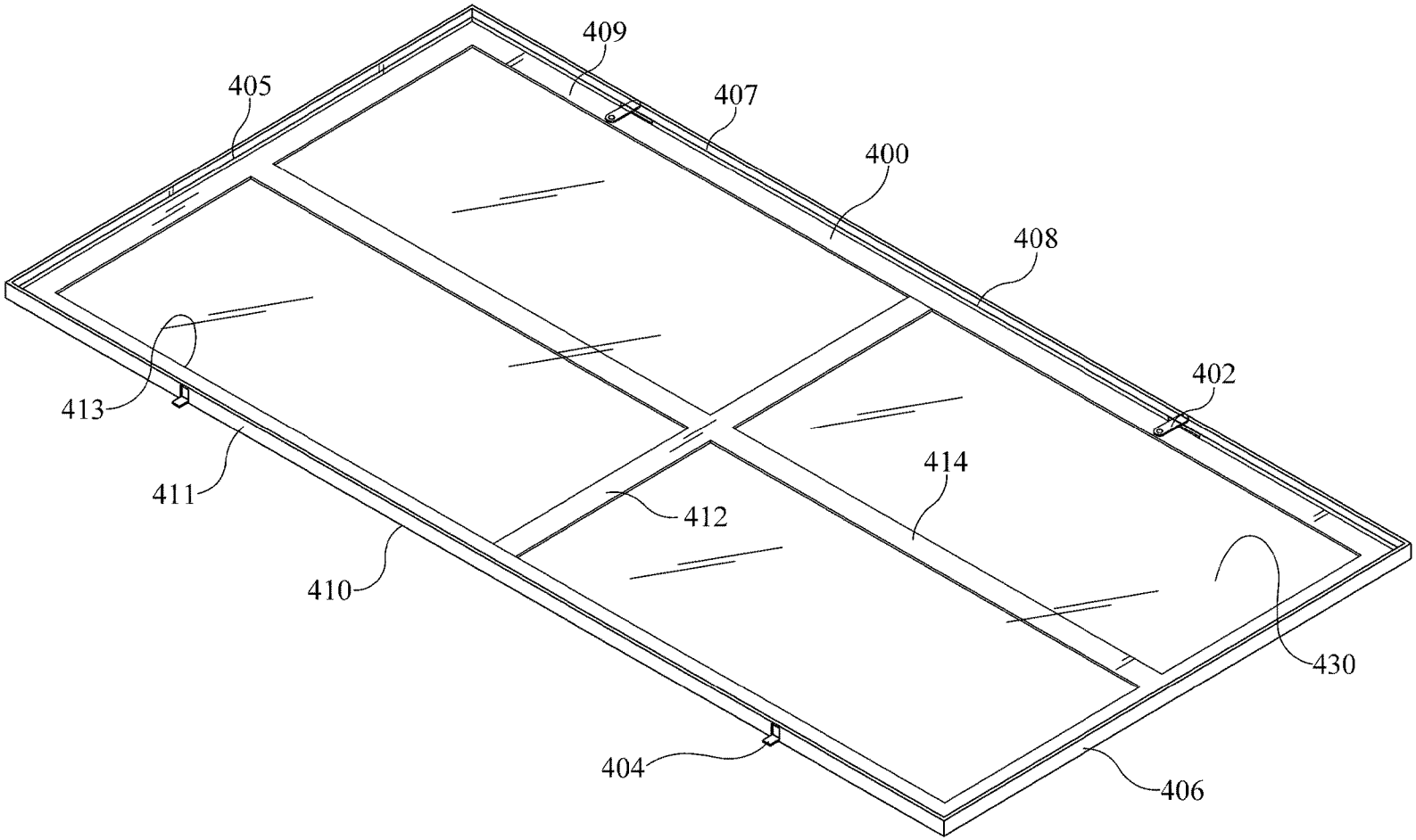

FIG. 8 graphically shows a method of installation of the presently disclosed lighting system in a ceiling support grid;

FIG. 9 is a perspective view of an alternative embodiment of the lighting system configured to be mounted with a ceiling support grid;

FIG. 10 is a lower perspective view of a lighting system of the present disclosure being installed in a ceiling support grid;

FIG. 11 is an upper perspective view of the lighting system shown in FIG. 10;

FIG. 12 is an upper perspective view of a lighting system showing cooperation of component parts holding the lighting to a ceiling support grid;

FIG. 13 shows a top and side view of a rectangular or square mounting frame of the present disclosure;

FIG. 14 shows a top and side view of an LED light source of the present disclosure;

FIG. 15 shows an illustrative example of an extension that may be used to hold a side of lighting system of the present disclosure; and FIGS. 16*a*, 16*b*, and 16*c* are illustrative cross-sectional views showing cooperation of component parts holding the lighting system to a ceiling support grid; and FIG. 17 is a perspective view of a removable mounting frame of the present disclosure configured to hold a louver, lens, or LED light source.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

This present disclosure addresses issues associated with ceiling support grid systems, such as lighting systems. Presently disclosed is a system for mounting a louver, a lens, or a rectangular or square light LED light source to a ceiling support grid. A mounting frame has at least one fixed flat extension extending from the first side and at least one retractable extension on a second side. The mounting frame is configured to be inserted into a grid opening and mounted to the grid and provide a frame for the mounting of a louver, a lens, or a rectangular or square light LED light source to the ceiling support grid. Embodiments of the present disclosure may provide light source that enables easy, or less laborious, installation, or retrofitting, of a light source. The lighting system of the present disclosure may be installed by placing a mounting frame on the ceiling support grid and installing a light source with the mounting frame.

The mounting frame may be configured to be inserted into a ceiling support grid opening and held therein. For example, the mounting frame may have holders in the form of flat fixed tabs that may be laid on a flange of the grid. These holders may be inserted between the flange and an existing installed troffer for retrofitting the existing troffer luminaire. The opposite side of the mounting frame may then be placed into the ceiling support grid and a retractable holder may be extended to cooperate with the opposite side flange of the ceiling support grid.

Upon installation of the mounting frame in the ceiling support grid opening, an LED light source may be installed. For example, one side of the light source may have fixed extension(s) configured to cooperate with the mounting frame and the opposite side may have clasps configured to clasp to the mounting frame. The LED light source may have a low profile, enabling it fit into an existing troffer for retrofitting. For example, the LED light source may be in the form of a planar panel or have shallow formations in a panel with LED lights.

Figure 1:
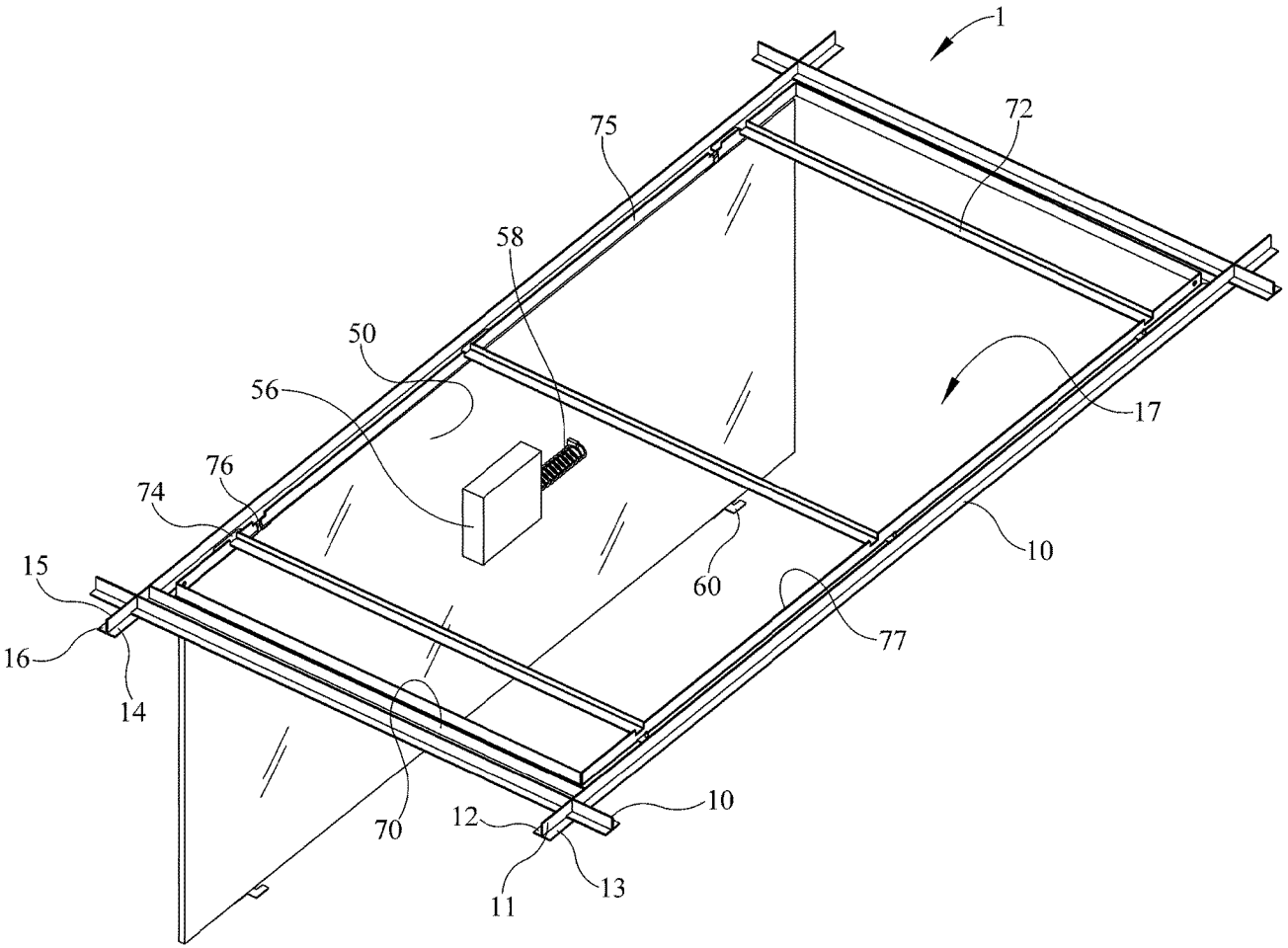
FIG. 1 is a perspective view of a lighting system configured to be mounted with a ceiling support grid.

FIG. 1 is a perspective view of an illustrative example of the presently disclosed lighting system 1 configured to be mounted with a ceiling support grid. Ceiling support grid 10 comprises at least one rectangular or square grid opening 17 with a first longitudinal flange 14 extending inward from a first side and a second longitudinal flange 12 extending inward from a second side. First flange 14 and second flange 12 are parallel with one another. Ceiling support grid 10 may have a "T" shaped cross section. For example, ceiling support grid support 10 may have a first side with inward extending flange 14, upward extending flange 15, and outward extending flange 16, and a second side with inward extending flange 12, upward extending flange 11, and outward extending flange 13.

Lighting system 1 has a rectangular or square mounting frame 70 configured to transform its outer perimeter from a first outer perimeter to a second outer perimeter. The first outer perimeter has at least one holder and enables mounting frame 70 to fit into the ceiling support grid and have the at least one holder 74 cooperate with the first longitudinal flange 14. The second outer perimeter enables the mounting frame to cooperate with the second longitudinal flange 12 and to be held with the ceiling support grid 10.

A rectangular or square light LED light source 50 is configured to be held to mounting frame 70. LED light source 50 has at least one extension 76 extending from a first longitudinal edge and at least one clasp 60 on a second longitudinal edge. The first longitudinal edge of LED light source 50 is parallel with the second longitudinal edge of LED light source 50. The at least one extension 76 is configured to cooperate with mounting frame 70 and the at least one clasp 60 is configured to clasp with mounting frame 70.

Mounting frame 70 may have one or more cross-members 72 extending from its first side to its second side. In at least one embodiment, at least one clasp 60 is configured and disposed to clasp to a cross-member 72. LED light source 50 may be a planar light panel. However, it is to be understood that LED light source 50 may have other configurations as are known in the art.

The presently disclosed lighting system 1 may comprise an electrical driver 56 which may be configured to be mounted proximate to, or on, LED light source 50. A coiled cord 58 may be in electrical communication with electrical driver 56 which may have an electrical connector, such as a quick connect. For example, electrical driver 56 may be magnetically mountable and may be magnetically on the non-light emitting side of light source 50. A magnetically mountable electrical driver 56 may also be mounted proximate light source 50, for example in a troffer being retrofitted with the presently disclosed lighting system.

Figure 2:
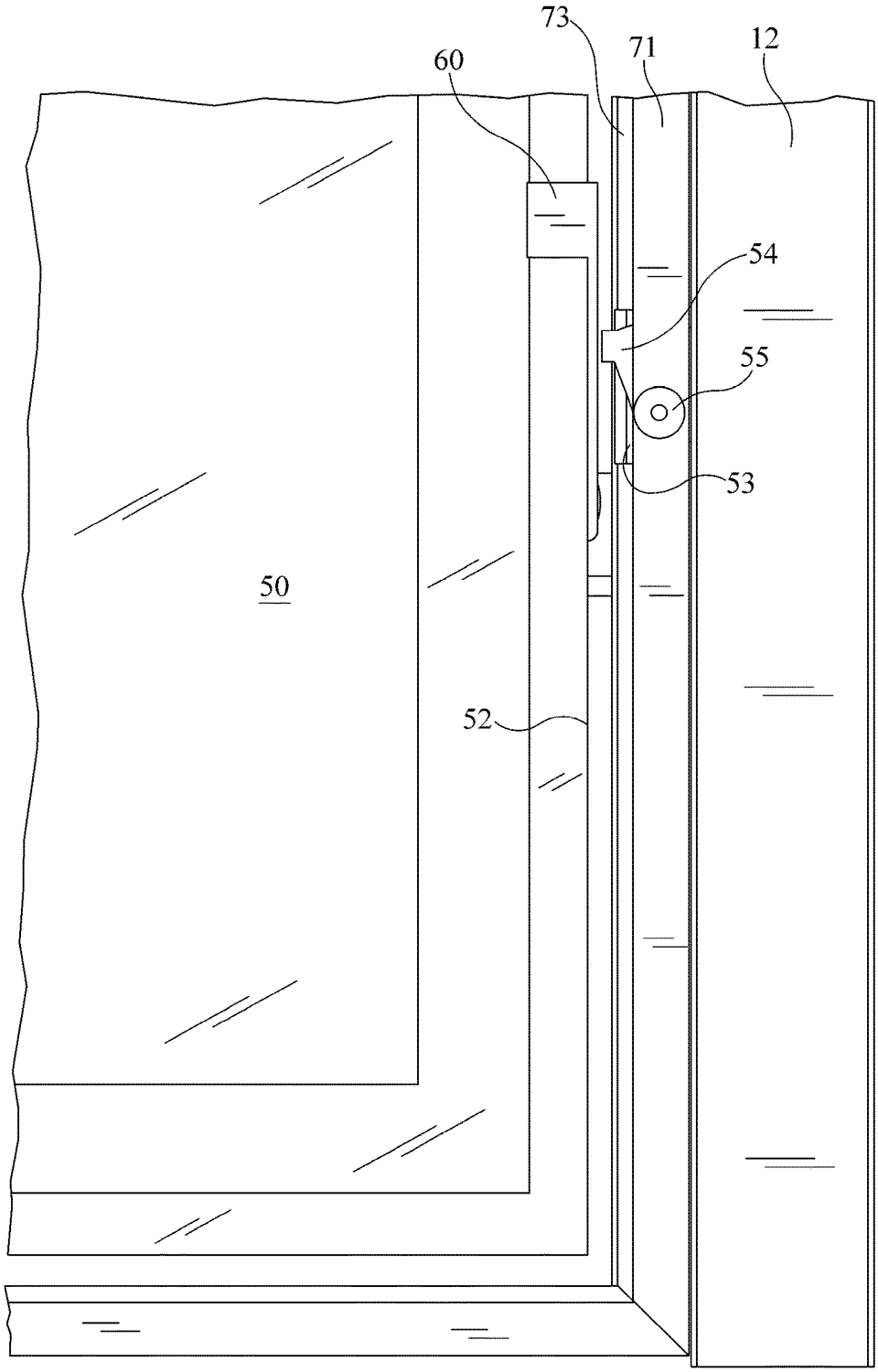
FIG. 2 is a lower cut-away view of the lighting system shown in FIG. 1, showing an illustrative example of a retractable holder in cooperation with a ceiling support grid and an illustrative example of a clasp in cooperation with a mounting frame.

FIG. 2 shows a lower cut-away view of lighting system 1 of the present disclosure showing an illustrative example of a retractable holder 54. Retractable holder 54 is shown an extended orientation and in cooperation with ceiling support grid 10, having second inward extending flange 12. For example, retractable holder 54 may be configured and disposed to retract into, and extend out of, a slot 53 in a side edge 73 of mounting frame 70. Retractable holder 54 may be rotatably mounted to frame 70 with pin 55. It is to be understood that upward extending side edge 73 may not be required.

Also shown in FIG. 2 is an illustrative example of clasp 60 in cooperation with mounting frame 70. For example, clasp 60 may be configured and disposed to clasp to at least one cross-member 72, extending between extending between the first and second sides, 75 and 77, of mounting 70.

Figure 3:
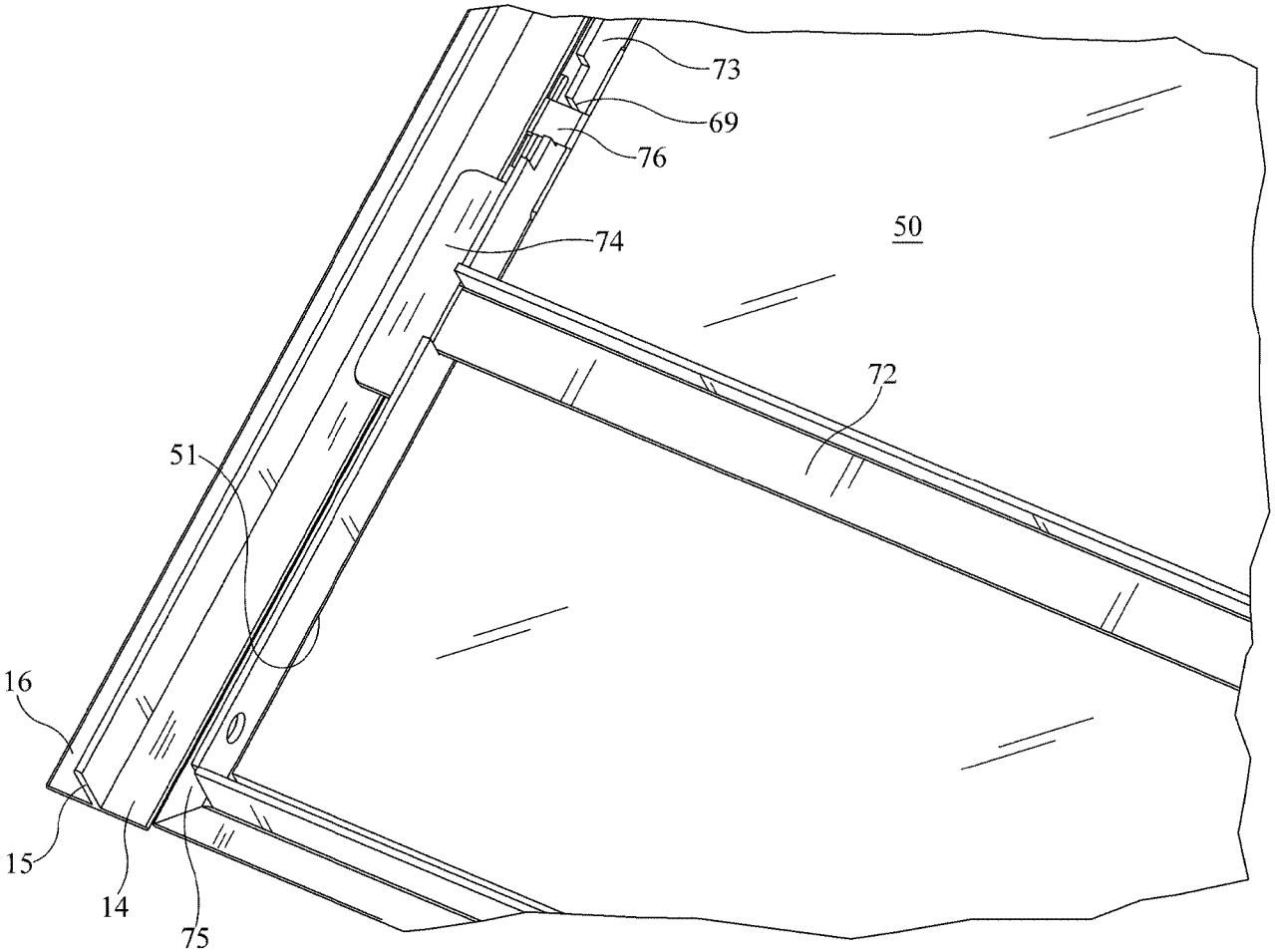
FIG. 3 is an upper cut-away view of the lighting system shown in FIG. 1, showing an illustrative example of a holder in cooperation with the ceiling support grid and an illustrative example of an extension in cooperation with the support frame.

FIG. 3 shows an upper cut-away view of the lighting system 1. An illustrative example of holder 74 is shown in cooperation with first inwardly extending flange 14, of ceiling support grid 10. Holder 74 may have a fixed flat tab extending outwardly from first side 75 of mounting frame 70. In at least one embodiment, frame 70 has upward extending edge 73 with an angular portion of holder 74 mounted thereto. A one cross-member 72 may extend from first side 75, of mounting frame 70, proximate holder 74.

FIG. 3 also shows an illustrative example of extension 76 in cooperation with support frame 70. Extension 76 extends from a first side edge 51, of light source 50, and may comprise a hook configured and disposed to hang LED light source 50 from mounting frame 70 and to pivot it about the hook.

Figure 4:
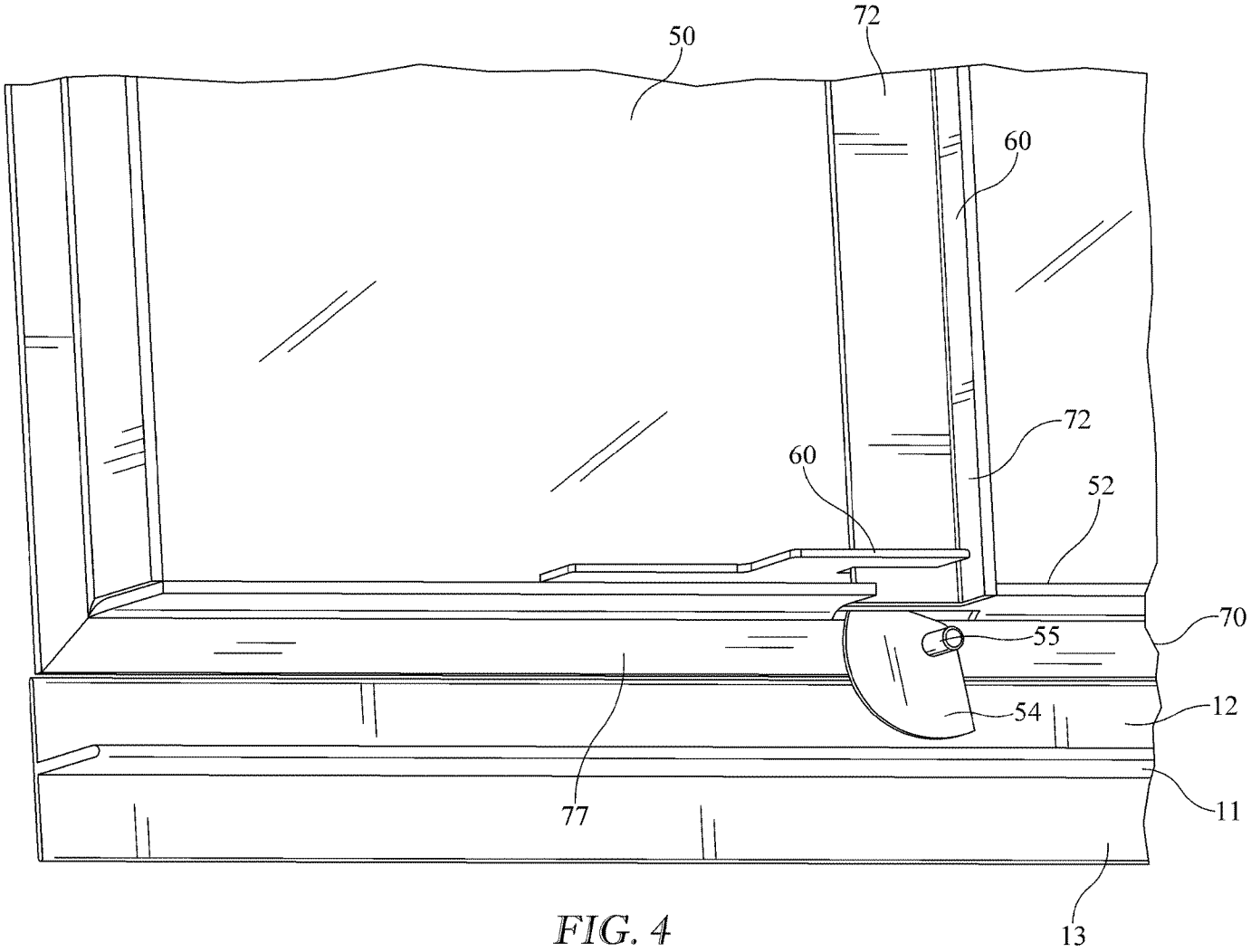
FIG. 4 is an upper cut-away view of the lighting system shown in FIG. 1, showing the illustrative retractable holder in cooperation with the ceiling support grid and the illustrative clasp in cooperation with the mounting frame.

FIG. 4 is an upper cut-away view of lighting system 1 showing the illustrative retractable holder 54 in cooperation with ceiling support grid 10 and illustrative clasp 60 in cooperation with mounting frame 70. Mounting frame 70 has the at least one retractable holder 54 proximate, or on, second side 77. Retractable holder 54 is rotatably mounted on second side 77, with pin 55, and is in an extended orientation, configuring mounting frame with a second, or larger, outer perimeter. The extension of retractable holder 54 may cooperate it with second inward extending longitudinal flange 12 by resting on it. In this illustrative embodiment, clasp 60 is clasp to cross-member 72. In at least one embodiment, retractable holder 54 may be configured and disposed to block clasping of clasp 60, upon the retraction of retractable holder 54. This may provide lighting system 1 with a safety feature, requiring the extension of retractable holder 54 to enable the clasping of clasp 60 with frame 70.

FIGS. 1 through 4 show at least one embodiment of lighting system 1 having mounting frame 70 with at least one holder 74 extending from a first side 75 and at least one retractable holder 54 proximate a second side 77. First side 75 and second side 77 are parallel. Retraction of retractable holder 54 configures mounting frame 70 with a first outer perimeter and the extension of retractable holder 54 configures mounting frame 70 with a second outer perimeter. Rectangular or square mounting frame 70 may be configured to transform its outer perimeter from the first outer perimeter to the second outer perimeter. The first outer perimeter may have at least holder 74 and enable mounting frame 70 to fit into opening 17, of ceiling support grid 10, and have at least one holder 74 cooperate with first longitudinal flange 14 of ceiling support grid 10. The second outer perimeter may be obtained by extending retractable holder 54 and may enable the mounting frame 70 to cooperate with second longitudinal flange 12 and hold mounting frame 70 with the ceiling support grid 10.

In at least one embodiment of the present disclosure, lighting system 1 is configured to be mounted with a ceiling support grid 10. Ceiling support grid 10 may comprise at least one rectangular or square grid opening 17 with a first longitudinal flange 14 extending inward from a first side and a second longitudinal flange 12 extending inward from a second side, the first flange 14 and the second flange 12 are parallel with one another. Rectangular or square mounting frame 70 is configured to be mounted in rectangular or square grid opening 17.

Rectangular or square LED light source 50 is configured to be held to mounting frame 70. LED light source 50 may have at least one extension 76 extending beyond a first longitudinal edge 51 and at least one clasp 60 on a second longitudinal edge. The first longitudinal edge 51 and the second longitudinal edge 52 of light source 50 are parallel. The at least one extension 76 may be configured to hang LED light source 50 from mounting frame 70 and to pivot it about the at least one extension 76. The at least one clasp 60 may be configured to clasp with mounting frame 70 and hold LED light source 50 to the mounting frame.

Rectangular or square mounting frame 70 may comprise at least one cross-member 72 extending from a first side to a second side, the first and second sides being parallel. At least one clasp 60 may be disposed with LED light source 50, clasp 60 may be configured to clasp to a cross-member 72, or other part of mounting frame 70.

Figure 5:
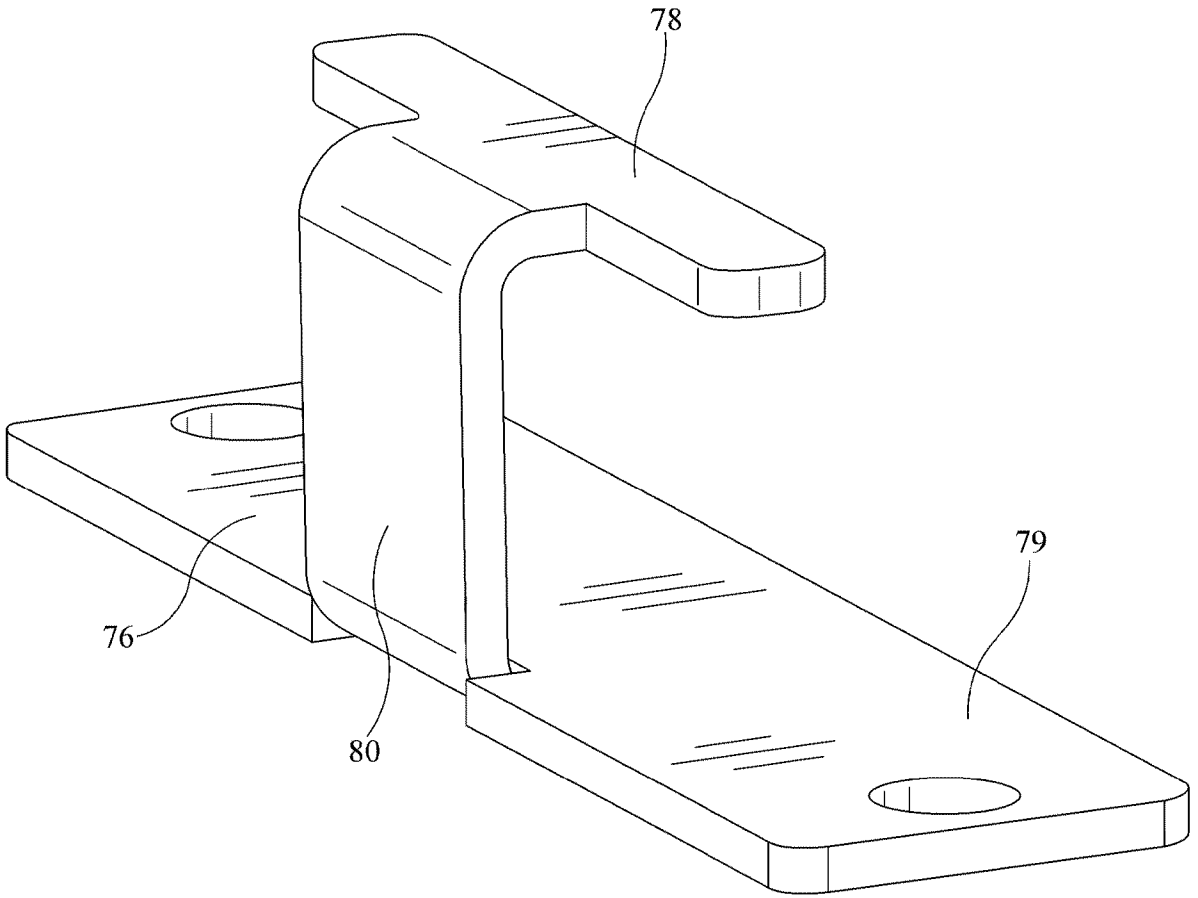
FIG. 5 is a perspective view of the illustrative extension shown in FIG. 3.

FIG. 5 is a perspective view of an illustrative extension 76 of the present disclosure. At least one extension 76 may extend from a side edge of LED light source 50, for example first side edge 51. Extension 76 is configured and disposed to hold first side edge 51 of LED light source 50 to mounting frame 70. Extension 76 may have a hook configuration and enable LED light source 50 to hang from mounting frame 70 and pivot about extension 76. For example, extension 76 may have a mounting plate 79 with apertures for mounting to an edge of LED light source 50. Hanger arm 80 may extend perpendicularly from mounting plate 79 and have hanger 78 on an end thereof. Hanger 78 may extend from hanger arm 80 and may be curved from hanger arm 80. Hanger 78 may have outward extensions configured to be inserted into a slot 69, in mounting frame 70. Upon a rotation of LED light source 50, the outward extensions on hanger 78 may be held in slot 69, holding extension 76 with mounting frame 70.

Figure 6:
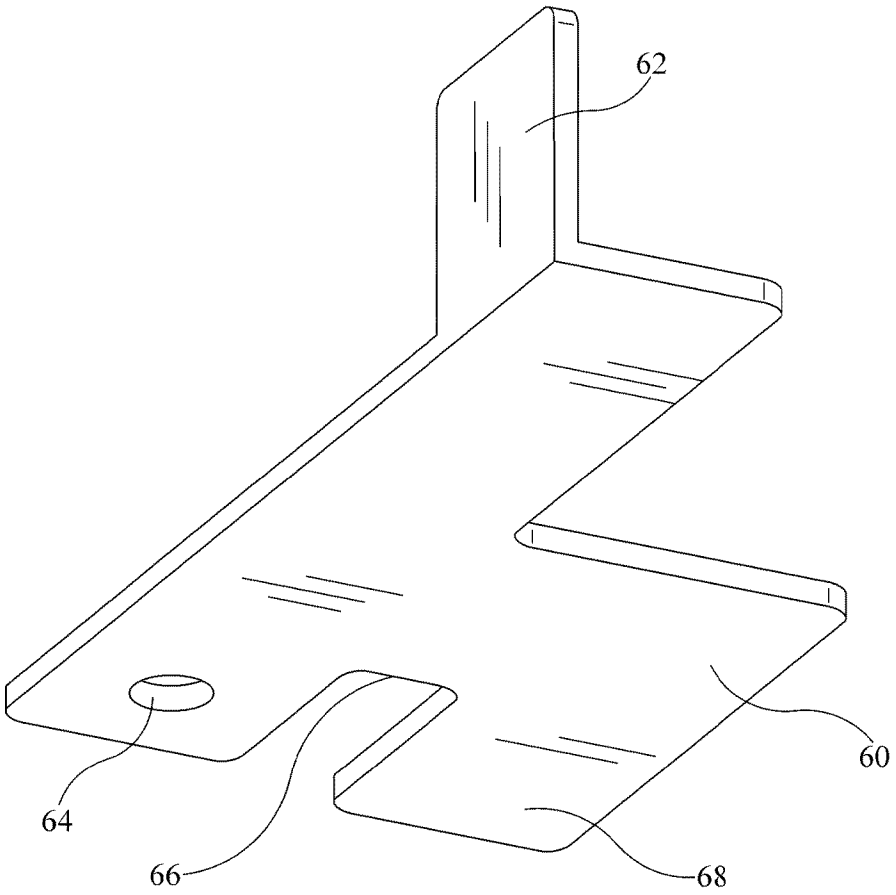
FIG. 6 is a perspective view of the illustrative clasp shown in FIG. 4.

FIG. 6 is a perspective view of clasp 60. Clasp 60 may be rotatably attached, at aperture 64, to a second edge 52 of light source 50. Clasp 60 may be configured to clasp on a portion of mounting frame 70 upon its rotation about aperture 64. For example, clasp 60 may have notch 66 configured and disposed to clasp and hold a cross-member 72. Clasp 60 may have a stop 62 configured and disposed to become substantially adjacent LED light source 50 upon clasping onto a portion of mounting frame 70. Clasping arm 68 may be configured and disposed with LED light source 50 to contact an extended retractable holder 54 and prevent clasping until retractable holder is extended.

Figure 7:
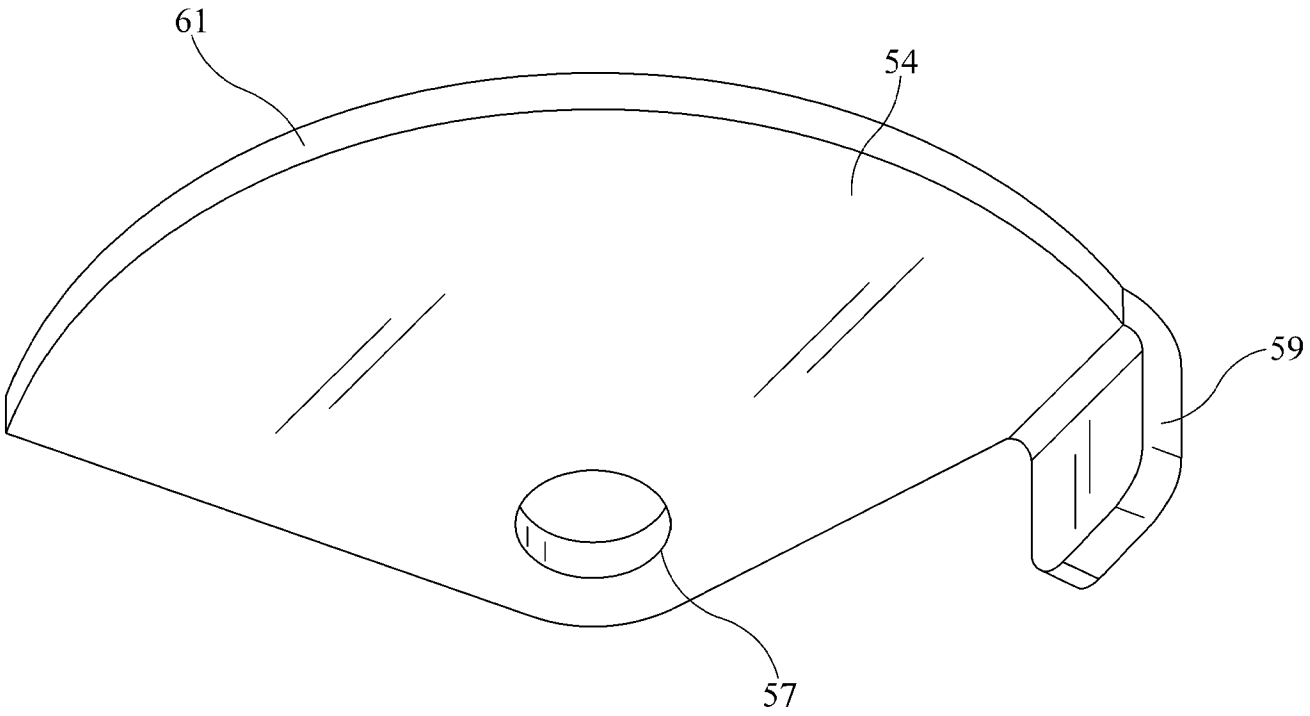
FIG. 7 is a perspective view of the illustrative retractable holder shown in FIG. 4.

FIG. 7 is a perspective view of the illustrative retractable holder 54. Retractable holder 54 may be configured to be rotatably attached to second side 77 of mounting frame 70. For example, a pin 55 may be extended through aperture 57 and hold retractable holder 54 to mounting frame 70. Retractable holder 54 may have a holding arm 61 extending outwardly from aperture 57. In at least one embodiment, holding arm 61 is configured to prevent clasp 60 from clasping until retractable holder 54 is rotated into an extended orientation. For example, holding arm 61 may be in the form of a circular segment. Retractable holder 54 may have a stop 59 on holding arm 61, stop 59 may be configured and disposed to become adjacent mounting frame 70, or frame edge 73, upon its extension.

In at least one embodiment, mounting frame 70 has at least one holder 74 extending from a first side and at least one retractable holder 54 proximate a second side, the first side and the second side are parallel, retraction of retractable holder 54 configures mounting frame 70 with a first outer perimeter and the extension of retractable holder 54 configures mounting frame 70 with a second outer perimeter, wherein the second outer perimeter is greater than the first outer perimeter.

FIG. 8 schematically shows a method of installation of the presently disclosed lighting system in a ceiling support grid. The lighting system shown in FIG. 8 comprises a mounting frame 170 and an LED light source 150. Mounting frame 170 is configured to be placed into a ceiling support grid opening and installed with ceiling support grid 110, as shown in the upper drawing. LED light source 150 is configured to be placed into mounting frame 170 and held therein. Mounting frame 110 and LED light source 150 may be configured to be installed without removal of existing light troffer 101, providing a lighting system and method for retrofitting. For example, holder 174 may be configured and disposed to fit between troffer 101 and a flange extending inward from ceiling support grid 110 and retractable holder 154 may be configured and disposed to extend between troffer 101 and a flange on the opposite side of ceiling support grid 110.

A method for installing a lighting system in a ceiling support grid may comprise installing a rectangular or square mounting frame 170 in a rectangular or square grid opening in ceiling support grid 110. Mounting frame 170 may be installed by laying holder 174 on an inwardly extending flange on ceiling support grid 110 and pivoting the other end of mounting frame 170 up into ceiling support grid 110, as depicted by arrow "A". In at least one embodiment, holder 174 is a fixed flat tab. Upon pivoting mounting frame 170 upward into ceiling support grid panel 110, retractable holder 154 may be extended outwardly from mounting frame 170 and laid on an inward extending flange of ceiling support grid 110.

Upon installing mounting frame 170 into ceiling support grid 110, LED light source 150 may be installed into mounting frame 170, as depicted in the lower drawing. This may comprise attaching a first longitudinal edge of LED light source 150 with a first side of mounting frame 170 by attaching extension 176 to a first side of mounting frame 170. In at least one embodiment, extension 176 is configured to hingedly hang LED light source 150 with mounting frame 170. LED light source 150 may pivoted about extension 176, as depicted by arrow "B", and the second side of LED light source 150 may be fit in mounting frame 170. A second longitudinal edge of the LED light source 150 may then be attached to a second side of mounting frame 170. For example, clasp 160 may be clasped onto mounting frame 170.

FIG. 9 is a perspective view of an alternative embodiment of the lighting system configured to be mounted with a ceiling support grid, lighting system 200. Lighting system 200 has mounting frame 270 configured to be mounted with ceiling support grid support 210. Mounting frame 270 has four sides, each having an "L" shaped cross-section. Cross-members 272 extend between adjacent perpendicular sides of mounting frame 270. One side has at least one holder 274 extending outward therefrom and an opposite side has at least one retractable holder 254. Holder(s) 274 are configured to rest on ceiling support grid 210 and retractable holder(s) 254 are configured to extend outward, from a retracted orientation, and rest on ceiling support grid 210.

Mounting frame 270 is also configured to have LED light source 250 mounted therewith. In at least one illustrative example, on one side, mounting frame 270 has notch 269 in an upward extending flange, and on an opposite side, mounting frame has 270 has pins 261 extending inward from an upward extending flange.

LED light source 250 is configured to be mounted with mounting frame 270. LED light source 250 has an LED holding portion 252, which may be in the form of an upward bump out portion or shallow troffer like portion. LED holding portion 252 may hold arrays of LEDs 248 on a lower lighting side of LED light source 250. At least one extension 276 extends outward from one side of LED light source 250. Extension(s) 276 may configured and disposed to cooperate with mounting frame 270 at notch 269. In at least one embodiment, extension(s) 276 have a curved hook like portion configured to hook onto the upward flange of mounting frame 270, about notch 269. On a side of LED light source, opposite the side having extension(s) 276, at least one clasp 260 is rotatably held therewith. Clasp(s) 260 are configured and disposed to clasp to pins 261, on mounting frame 270, and hold light source 250 to mounting frame 270.

FIG. 10 shows a lower perspective view of a lighting system of the present disclosure being installed in a ceiling support grid. FIG. 11 shows an upper perspective view of the lighting system and FIG. 12 shows cooperation of component parts of the lighting system.

With reference to FIGS. 10, 11, and 12, lighting system 300 is shown being installed in a ceiling support grid 310. Ceiling support grid 310 comprises at least one rectangular or square grid opening 17 with a first longitudinal flange 312 extending inward from a first side and a second longitudinal flange 314 extending inward from a second side. First flange 312 and second flange 314 are parallel with one another.

Rectangular or square mounting frame 370 is configured to be mounted in the rectangular or square grid opening 17 and has a first side 320, a second side 318, a third side 319, and a fourth side 321. Each of the sides are joined at terminal ends to form rectangular or square mounting frame 370.

A corner support 372 may extend between two of the joined sides of mounting frame 370. At least one fixed flat extension 376 or 377 extends out from a first side 318 of mounting frame 370 and at least one retractable extension 354 is configured and disposed to extend out from a second side 320 mounting frame 370, wherein the first side of mounting frame 370 and the second side of the mounting frame 370 are parallel. At least one leg 371 may extend in from one of the sides of mounting frame 370.

A rectangular or square LED light source 350 is configured to be held to mounting frame 370. LED light source 350 has at least one extension 378 extending beyond a first side 322 and at least one clasp 360 on a second side 324. First side 322 and second side 324 are parallel. The at least one extension 378 is configured to hold first side 322 of LED light source 350 with one of the sides of mounting frame 370. The at least one clasp 360 is configured to clasp with leg 371, extending in from second side 320 of mounting frame 370, and hold LED light source 350 to mounting frame 370.

The at least one extension 378, extending beyond the first side 322 of LED light source 350, may be configured to hang LED light source 350 from mounting frame 370 and to pivot LED light source 350 about the at least one extension 378.

LED light source 350 may have a volumetric housing 348 that may hold an array of LED lights above a plane of ceiling support grid 310. A lens or light diffuser 351 may be held with LED light source 350, about the array of LED lights. Volumetric housing 348 may hold lens or light diffuser 351 above the plane of the ceiling support grid 310.

Lighting system 300 may be configured to retrofit a troffer light source, having an existing troffer 301. For example, LED light source 350, or volumetric housing 348, may be configured to fit in existing troffer 301. The at least one fixed flat extension 376, extending from the mounting frame 370, may be configured and disposed to fit between troffer 301 and first flange 312, and the at least one retractable extension 354 may be configured and disposed to extend out and between troffer 301 and second flange 314.

Lighting system 300 may have a driver 352, which may be mounted on LED light source 350. A driver mount 353 may be on a non-light emitting side of LED light source 350.

Rectangular or square mounting frame 370 has a first side 320, a second side 318, a third side 319, and a fourth side 321. Each of the sides are joined at terminal ends to form rectangular or square mounting frame 370. One or more corner supports 372 may extend between joined sides of mounting frame 370. First side 318 has fixed flat extensions, for example fixed flat extensions 376 or 377, extending outward in a plane parallel with mounting frame 370. Fixed flat extensions, 376 and 377, may have a variety of configurations. Fixed flat extensions 376 and 377 have a width proximate first side 318 greater than or equal to a width proximate a terminal end thereof. The fixed flat extensions presently disclosed may be rectangular, square, triangular, rounded, or have another configuration and disposition for laying on first flange 312 of ceiling support grid 310 and removably hold first side 318 with ceiling support grid 310.

FIG. 13 shows a top and side view of rectangular or square mounting frame 370 of the present disclosure. Mounting frame 370 may be a part of a system for mounting a louver, a lens, or a rectangular or square light LED light source to ceiling support grid 310. For example, rectangular or square mounting frame 370 may be configured for mounting a louver, a lens, or a rectangular or square light LED light source to ceiling support grid 310. Mounting frame 370 may have a first side 318, a second side 320, a third side 319, and a fourth side 321, wherein the sides are joined at terminal ends, forming corners of mounting frame 370, first side 318 and second side 320 are parallel with one another. At least one fixed flat extension 377 extends from the first side 318 and in a plane parallel with a plane of mounting frame 370. Each of the fixed flat tabs has a width proximate first side 318 greater than or equal to a width proximate a terminal end thereof. Each fixed flat extension 377 is configured and disposed to lie on first flange 312 of the ceiling support grid 310 and removably hold first side 318 with ceiling support grid 310.

At least one retractable extension 354 is disposed on second side 320 and is configured to have a portion extended from second side 320 and in a plane parallel with the plane of mounting frame 370, and retracted into second side 320. Retractable extension 354 is configured for passing mounting frame 370 into the ceiling support grid 310, through the at least one rectangular or square grid opening 17, upon at least one fixed flat extension 377 being laid on first flange 312 of the ceiling support grid 310 and the at least one retractable extension 354 being in the retracted position. The at least one retractable extension is configured for holding mounting frame 370 with the ceiling support grid 310 upon at least one tab being laid on the first flange 312, of ceiling support grid 310, and the at least one retractable extension 354 being in the extended position and laid on second flange 314 of ceiling support grid 310.

FIG. 14 shows a top and side view of LED light source 350 of the present disclosure. Rectangular or square LED light source 350 is configured to be held to a ceiling support grid, with the mounting frame of the present disclosure. LED light source has at least one extension 378 extending beyond a first side 322. At least one clasp 360 is on a second side 324, wherein first side 322 and second side 324 are parallel.

The at least one extension 378 is configured to hold first side 322 of LED light source 350 with one of the sides of the mounting frame. The at least one clasp 360 is configured to clasp with the mounting frame, for example leg 371 extending in from the side of the mounting frame, and hold LED light source to the mounting frame. It is to be understood that clasp 360 may be configured and disposed to clasp any portion of mounting frame 370 and that legs 371 may not be incorporated with mounting frame 370. For example, mounting frame 370 may have corner supports 272, shown in FIG. 9, and clasp 360 may be configured and disposed to grasp corner support 272.

The at least one extension 378, extending beyond first side 322 of LED light source 350, may be configured to hang LED light source 350 from the mounting frame 370 and to pivot LED light source 350 about the at least one extension 378. LED light source 350 may be hung from mounting frame 370 to ease connecting light source 350 to a power supply. LED light source 350 may have a volumetric housing 348 configured to hold an array of LED lights above a plane of the ceiling support grid.

In at least one embodiment, a lens or light diffuser is held with LED light source 350, about the array of LED lights. Volumetric housing 348 may be configured to hold the lens or light diffuser above the plane of the ceiling support grid. Volumetric housing 348 may be configured to fit in an existing troffer or portion of a luminaire being retrofitted. A driver 352 may be mounted on LED light source 350. In at least one embodiment, a driver mount 353 is disposed on a non-light emitting side of LED light source 350, for mounting driver 352.

Disclosed herein is a system for mounting a louver, a lens, or a rectangular or square light LED light source to a ceiling support grid. The ceiling support grid has at least one rectangular or square grid opening with a first flange extending inward from a first side and a second flange extending inward from a second side.

The system has a rectangular or square mounting frame configured for mounting a louver, a lens, or a rectangular or square light LED light source to the ceiling support grid. Rectangular or square mounting frame 370 has a first side 318, a second side 320, a third side 319, and a fourth side 321, wherein the sides are joined at terminal ends, forming corners of mounting frame 370, first side 318 is parallel with second side 320. At least one fixed flat extension 377 extends from first side 318 and in a plane parallel with a plane of mounting frame 370. Each of the fixed flat extensions has a width proximate first side 318 greater than or equal to a width proximate a terminal end thereof and are configured and disposed to lay on first flange 312 of ceiling support grid 310 and removably hold first side 318 with ceiling support grid 370.

At least one retractable extension 354 is configured to have a portion extended from second side 320 and in a plane parallel with the plane of mounting frame 370, and to be retracted into second side 320. Retractable extension 354 is configured for passing the mounting frame into ceiling support grid 310, through at least one rectangular or square grid opening 17, upon the at least one fixed flat extension 377 being laid on first flange 312 of ceiling support grid 310 and the at least one retractable extension 354 being in the retracted position. The at least one retractable extension 354 is configured for holding mounting frame 370 with ceiling support grid 310 upon the at least one fixed flat extension 377 being laid on first flange 312 of ceiling support grid 310 and the at least one retractable extension 354 being in the extended position and laid on second flange 314 of ceiling support grid 310.

Mounting frame 370 may have a corner support 372 in one or more corners. At least one leg 371 may extend inward from one of the sides of mounting frame 370. Mounting frame 370 may have at least one notch 379 in an upper portion of one of the sides. Notch 379 may be configured and disposed to receive a portion of extension 378.

The system may have a louver, lens, or rectangular or square LED light source configured to be mounted to mounting frame 370. LED light source 350 has at least one extension 378 extending beyond first side 322 and at least one clasp 360 on a second side 324, wherein first side 322 is parallel with second 324. The at least one extension 378 is configured to hold first side 322 of LED light source 350 with one of the sides of mounting frame 370 and the at least one clasp 360 is configured to clasp with mounting frame 370 and hold LED light source 350 to mounting frame 370.

The at least one extension 378, extending beyond first side 322 of LED light source 350, may be configured to hang LED light source 350 from mounting frame 370 and to pivot LED light source 350 about the at least one extension 378. LED light source may be a volumetric light source, or have a volumetric housing 348 configured to hold an array of LEDs above a plane of ceiling support grid 310.

FIG. 15 shows an illustrative example of an extension that may be used to hold a side of lighting system of the present disclosure to mounting frame 370. The extension extending from first side 322 of LED light source 350 is configured to hold first side 322 to mounting frame 370 and may have a variety of configurations. For example, extension 76, shown in FIG. 5, may extend from first side 322 for holding to mounting frame 370. In at least one embodiment of the present disclosure, extension 378 may be attached to first side 322. Extension 378 is configured and disposed to hold side 322 of LED light source 350 to first side 318 of mounting frame 370. Extension 378 may have a hook or "U" configuration and enable LED light source 350 to hang from mounting frame 370 and pivot about extension 378. For example, extension 378 may have a mounting plate 382 with apertures for mounting to first side 322 of LED light source 350. Arms 380 may extend from mounting plate 382, which may be adapted for mounting on an upper surface of an LED light source. In the embodiment of LED light source 350 shown in the FIGs., arms 380 may not be needed. However, embodiments of LED light source 350 that have a surface for mounting extension 378 are within the scope of the present disclosure. Hanger arm 383 may extend perpendicularly from mounting plate 382 and have hanger 381 on an end thereof. Hanger 381 may extend from hanger arm 383 and may be curved from hanger arm 383. Hanger 381 may have outward extensions configured to be held in a notch 379, in an upper portion of one of the sides of the mounting frame 370. The outward extensions on hanger 381 may be held in slot 379, pivotally hanging LED light source 350 with mounting frame 370.

FIGS. 16*a*, 16*b*, and 16*c* are illustrative cross-sectional views showing cooperation of component parts holding the lighting system to a ceiling support grid. The illustrations show the cross-sectional components in line form for clarity, the thicknesses of the components are not represented with the line drawings. Additionally, spacing between components is exemplified for clarity as many components have little or no spacing therebetween.

FIG. 16*a* illustrates a cross-section of a lighting system of the present disclosure taken at a plane void of extensions and clasps for holding LED light source 350 to ceiling support grid 310. As shown therein, first inward extending flange 312 is adjacent first side 318 of mounting frame 370 and first side 322 of LED light source 350 is adjacent first side 318 of mounting frame 370. The spacing between first inward extending flange 312, first side 318, and first side 322 is exaggerated in the FIGs. for clarity. In at least one embodiment, the spacing between first inward extending flange 312, first side 318, and first side 322 is negligible and provides a substantially flat and continuous appearance. Existing troffer 301, being retrofitted in this illustration, extends upwardly from proximate inward extending flange 312.

Shown to the right in FIG. 16*a*, second inward extending flange 314 is adjacent second side 320 of mounting frame 370 and second side 324 of LED light source 350 is adjacent second side 320 of mounting frame 370. The spacing between second inward extending flange 314, second side 320, and second side 324 is exaggerated in the FIGs. for clarity. In at least one embodiment, the spacing between second inward extending flange 314, second side 320, and second side 324 is negligible and provides a substantially flat and continuous appearance. Existing troffer 301, being retrofitted in this illustration, extends upwardly from proximate inward extending flange 312.

FIG. 16*b* illustrates a cross-section of a lighting system of the present disclosure taken at a plane having retractable extensions 354 and fixed flat extension 376 for holding mounting frame 370 to ceiling support grid 310. In the illustration on the left, retractable extension 354 is extended outward from first side 318 and is lying on first inward extending flange 312 of ceiling support grid 310. In at least one embodiment of the present disclosure, retractable extension 354 has a configuration like retractable holder 54 having stop 59, shown in FIG. 7, and extends outward through a slot in first side 318. Existing troffer 310 is resting on retractable extension 354. In the illustration on the right, fixed flat extension 376 is extended outward from second side 320 and is lying on second inward extending flange 314 of ceiling support grid 310. Existing troffer 310 is resting on fixed flat extension 376.

FIG. 16*c* illustrates a cross-section of a lighting system of the present disclosure taken at a plane having clasp 360 and extension 378 for holding LED light source 350 to mounting frame 370. In the illustration on the left, clasp 360 is shown clasping mounting frame 370, or leg 371 extending from mounting frame 370. In at least one embodiment of the present disclosure, clasp 360 has a configuration like clasp 60, shown in FIG. 6, and has stop 62. In the illustration on the right, extension 378 is shown holding second side 324 of LED light source 350 to mounting frame 370, at notch 379.

Mounting frame 370 may be configured for mounting a louver, a lens, or a rectangular or square light LED light source to ceiling support grid 310. For example, co-pending patent application Ser. No. 15/181,171, the entire contents of which are incorporated herein by reference, discloses a louver or lens holder configured to hold a louver or lens to a ceiling support grid and to transform its outer perimeter from a first outer perimeter to a second outer perimeter. The first outer perimeter may have at least one fixed flat extension 377 and enable the louver or lens holder to fit into the ceiling support grid and have the at least one fixed flat extension 377 rest on the first flange 312. The second outer perimeter, formed with the extension of retractable extension 354, enables the louver or lens holder to cooperate with the second flange 314 and to be held with the ceiling support grid 310.

FIG. 17 shows an illustrative example of a system for mounting a louver, a lens, or a rectangular or square light LED light source to a ceiling support grid. For example, the mounting frame of the present disclosure may be in the form of a removable louver, lens, or light source holder 400 which may comprise a rectangular or square frame having a first side 410 with a first side edge 411 and a second side 408 with a second side edge 407. A third side 405 and a fourth side 406 may extend between first and second sides 410 and 408. First side 410 may have a portion extending inwardly, 413, from first side edge 411 and second side 408 may have a portion extending inwardly, 409, from second side edge 407. Third and fourth sides 405 and 406 may be similarly configured and have the same cross-sections as first and second sides 410 and 408.

In at least one illustrative example, each side edge, for example 407 and 411, may extend perpendicularly to a louver, lens, or opening of a light source and may be configured to extend into a troffer or luminaire, such as existing troffer 301, and mitigate light leakage between louver, lens, or light source holder 400 and ceiling support grid 310. In at least one other illustrative example, inwardly extending portions 409 and 413 are configured and disposed to become flush with ceiling support grid 310 upon louver, lens, or light source holder 400 being held with ceiling support grid 310.

In at least one other illustrative example, louver, lens, or light source holder 400 is configured to solely hold LED light source 350 or louver or lens 430 to ceiling support grid 310. For example, louver, lens, or light source holder 400 may be held with ceiling support grid 310 only, in the absence of an existing luminaire or troffer 301.

First side edge 411 and the second side edge 407 are parallel with one another. At least one extension, for example tab, or fixed flat extension, 404, extends from the first side edge 411. At least one locking mechanism 402, or retractable extension 354, has a portion configured to be extended from, and retracted into, second side edge 407. At least one tab 404, or fixed flat extension 376, may be configured and disposed to cooperate with, or lay upon, ceiling support grid 310 and removably hold first side 410 with the ceiling support grid 310.

The at least one locking mechanism 402 may be configured for passing removable louver or lens holder 400 into opening 17 in ceiling support grid 310, upon the at least one tab 404 being cooperated with ceiling support grid 310 and the at least one locking mechanism 402 being in the retracted position. The at least one locking mechanism 402 may be configured for holding removable louver, lens, or light source holder 400 with the ceiling support grid 310 upon at least one tab 404 being cooperated with, or laid upon, ceiling support grid 310 and the at least one locking mechanism 402 being in the extended position. For example, portions of tabs 404 and extended locking mechanism 402 may lie on portions of ceiling support grid 310.

It is to be understood that louver, lens, or light source holder 400 may have a plurality of locking mechanisms 402, or retractable extensions 354, spaced about its perimeter. Placement of selected locking mechanisms 402 in a retracted position may provide louver, lens, or light source holder 400 with a first perimeter that may enable louver, lens, or light source holder 400 to be placed into ceiling support grid 310. Upon placing louver, lens, or light source holder 400 into ceiling support grid 310, placement of selected locking mechanisms in an extended position may provide louver, lens, or light source holder 400 with a second perimeter that may enable louver, lens, or light source holder 400 to be held with ceiling support grid 310.

Removable louver, lens, or light source holder 400 may have at least one cross-member 412 extending from its first side 410 to its second side 408 which may provide additional support for louver or lens 430. Additional cross-members, such as cross-members 414, may also be disposed with removable louver, lens, or light source holder 400. The cross-members may provide an aesthetic design about a lower surface of louver or lens 430.

A method of installing a frame in a ceiling support grid is presently disclosed. At least one fixed flat extension, extending from a first side of the frame, is inserted into an opening in the ceiling support grid and rested on the ceiling support grid. The frame is pivoted about the at least one fixed flat extension and placed substantially within a plane of the ceiling support grid. At least one retractable support is extended outwardly from a second side of the frame and rested on the ceiling support grid, and thereby holding the frame with the ceiling support grid. The first side of the frame is parallel with the second side of the frame.

The presently disclosed method may be performed to cover or retrofit an existing troffer in the ceiling support grid. For example, the step of inserting at least one fixed flat extension into a ceiling support grid opening and resting the at least one fixed flat extension on the ceiling support grid may comprise inserting the at least one fixed extension between an existing troffer and the ceiling support grid and the step of extending at least one retractable support outwardly may comprise extending the at least one retractable support between the existing troffer and the ceiling support grid. The existing troffer, or troffer being retrofitted, may lie on the at least one fixed flat extension and the at least one retractable support.

An LED light source may be installed in the ceiling grid with the presently disclosed method. For example, a first side of an LED light source may be attached with one of the sides of the frame and a second side of the LED light source may be attached with a parallel side of the frame. In at least one embodiment, attaching the first side of the LED light source with the frame comprises hingedly hanging the LED light source from one of the sides of the frame and the step of attaching a second side of the LED light source with a parallel side of the frame comprises pivoting the LED light source about the first side of the LED light source. The step of attaching the second side of the LED light source with the frame may comprise clasping the second side of the LED light source to the frame.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims.

The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

AT LEAST PARTIAL NOMENCLATURE

1 lighting system
10 ceiling support grid
11 second upward extending longitudinal flange
12 second inward extending longitudinal flange
13 second outward extending longitudinal flange
14 first inward extending longitudinal flange
15 first upward extending longitudinal flange
16 first outward extending longitudinal flange
17 grid opening
50 LED light source
51 first side edge of LED light source
52 second side edge of LED light source
53 slot
54 retractable holder
55 pin
56 electrical driver
57 aperture
58 coiled cord
59 stop
60 clasp
61 holding arm
62 tab
64 aperture
66 notch
68 clasping arm
69 slot
70 rectangular or square mounting frame
72 cross-member
73 frame edge
74 holder
75 first side of mounting frame
76 extension
77 second side of mounting frame
78 hanger
79 mounting plate
80 hanger arm
101 troffer
110 ceiling support grid
150 LED light source
154 retractable holder
160 clasp
170 rectangular or square mounting frame
174 holder
176 extension
200 lighting system
210 ceiling support grid
248 LED array
250 LED light source
252 LED holding portion
254 retractable holder
260 clasp
261 pin
269 notch
270 mounting frame
272 cross-member
274 holder
276 extension
300 lighting system
301 existing troffer
310 ceiling support grid
311 first upward extending longitudinal flange
312 first inward extending longitudinal flange
313 first outward extending longitudinal flange
314 second inward extending longitudinal flange
315 second upward extending longitudinal flange
316 second outward extending longitudinal flange
318 first side of rectangular or square mounting frame
319 third side of rectangular or square mounting frame
320 second side of rectangular or square mounting frame
321 fourth side of rectangular or square mounting frame
322 first side of LED light source
324 second side of LED light source
348 volumetric housing
350 rectangular or square LED light source
351 diffuser or lens
352 driver
353 driver mount
354 retractable extension
360 clasp
370 rectangular or square mounting frame
371 leg
372 corner support
376 fixed flat extension
377 fixed flat extension
378 extension
379 notch
380 arm
381 hanger
382 mounting plate
383 hanger arm
400 removable louver, lens, or light source holder
402 locking mechanism
404 tab
405 third side of frame
406 fourth side of frame
407 second side edge of frame
408 second side of frame
409 inwardly extending portion
410 first side of frame
411 first side edge of frame
412 cross-member
413 inwardly extending portion
414 cross-member
430 louver or lens

The invention claimed is:

1. A lighting system configured to be mounted with a ceiling support grid comprising:

the ceiling support grid comprising at least one rectangular or square grid opening with a first longitudinal flange extending inward from a first side of the ceiling support grid and a second longitudinal flange extending inward from a second side of the ceiling support grid, wherein the first flange and the second flange are parallel with one another, a rectangular or square mounting frame configured to be mounted in the rectangular or square grid opening, the mounting frame comprising:

a first side, a second side, a third side, and a fourth side, wherein each of the sides of the rectangular or square mounting frame are joined at terminal ends to form the rectangular or square mounting frame;

a corner support extending between two of the joined sides of the mounting frame;

at least one fixed flat extension extending out from the first side of the mounting frame;

at least one retractable extension configured and disposed to extend out from the second side the mounting frame, wherein the first side of the mounting frame and the second side of the mounting frame are parallel;

a rectangular or square LED light source configured to be held to the mounting frame, the LED light source comprising:

at least one extension extending beyond a first side of the LED light source;

at least one clasp on a second side of the LED light source, wherein the first side of the LED light source and the second side of the LED light source are parallel;

the at least one extension extending beyond the first side of the LED light source being configured to hold the first side of the LED light source with one of the sides of the mounting frame; and the at least one clasp being configured to clasp with another of the sides of the mounting frame and hold the LED light source to the mounting frame.

2. The lighting system of claim 1, wherein the at least one extension extending beyond the first side of the LED light source is configured to hang the LED light source from the mounting frame and to pivot the LED light source about the at least one extension extending beyond the first side of the LED light source.

3. The lighting system of claim 1 further comprising a driver configured to be mounted on the LED light source.

4. The lighting system of claim 3 further comprising a driver mount on a non-light emitting side of the LED light source.

5. The lighting system of claim 1, wherein the rectangular or square LED light source has a volumetric housing configured to hold an array of LED lights above a plane of the ceiling support grid.

6. The lighting system of claim 5 being configured to retrofit a troffer light source, wherein the volumetric housing is configured to fit in an existing troffer, the at least one fixed flat extension, extending from the mounting frame, is configured and disposed to fit between the troffer and the first flange, and the at least one retractable extension is configured and disposed to extend between the troffer and the second flange.

7. The lighting system of claim 5 further comprising a lens or light diffuser held with the LED light source, about the array of LED lights.

8. The lighting system of claim 7, wherein the volumetric housing is configured to hold the lens or light diffuser above the plane of the ceiling support grid.

9. A system for mounting a louver, a lens, or a rectangular or square LED light source to a ceiling support grid, the ceiling support grid having at least one rectangular or square grid opening with a first flange extending inward from a first side and a second flange extending inward from a second side, the system comprising:

a rectangular or square mounting frame configured for mounting the louver, the lens, or the rectangular or square light LED light source to the ceiling support grid, the mounting frame comprising:

a first side, a second side, a third side, and a fourth side, wherein the sides are joined at terminal ends, forming corners of the mounting frame, the first side of the mounting frame and the second side of the mounting frame are parallel with one another;

at least one fixed flat extension extending from the first side of the mounting frame and in a plane parallel with a plane of the mounting frame, each of the at least one fixed flat extension having a width proximate the first side of the mounting frame greater than or equal to a width proximate a terminal end thereof and being configured and disposed to lay on the first flange of the ceiling support grid and removably hold the first side of the mounting frame with the ceiling support grid;

at least one retractable extension configured to have a portion extended from the second side of the mounting frame and in a plane parallel with the plane of the mounting frame, and retracted into the second side of the mounting frame;

wherein the at least one retractable extension is configured for passing the mounting frame into the ceiling support grid, through the at least one rectangular or square grid opening, upon the at least one fixed flat extension being laid on the first flange of the ceiling support grid and the at least one retractable extension being in a retracted position; and wherein the at least one retractable extension is configured for holding the mounting frame with the ceiling support grid upon the at least one fixed flat extension being laid on the first flange of the ceiling support grid and the at least one retractable extension being in an extended position and laid on the second flange of the ceiling support grid.

10. The system claim 9, wherein the mounting frame comprises a corner support in each of the corners.

11. The system of claim 9 further comprising at least one leg extending inward from one of the sides of the mounting frame.

12. The system of claim 9 further comprising at least one notch in an upper portion of one of the sides of the mounting frame.

13. The system of claim 9 comprising the rectangular or square LED light source configured to be mounted to the mounting frame, the LED light source comprising:

at least one extension extending beyond a first side of the LED light source;

at least one clasp on a second side of the LED light source, wherein the first side of the LED light source and the second side of the LED light source are parallel;

the at least one extension being configured to hold the first side of the LED light source with one of the sides of the mounting frame; and the at least one clasp being configured to clasp with the mounting frame and hold the LED light source to the mounting frame.

14. The system of claim 13, wherein the at least one extension extending beyond the first side of the LED light source is configured to hang the LED light source from the mounting frame and to pivot the LED light source about the at least one extension extending beyond the first side of the LED light source.

15. The system of claim 13, wherein the rectangular or square LED light source is a volumetric light source configured to hold an array of LEDs above a plane of the ceiling support grid.

16. A method of installing a rectangular or square mounting frame in a ceiling support grid, the method comprising the steps of:

inserting at least one fixed flat extension, extending from a first side of the frame, into a ceiling support grid opening, positioning the at least one fixed extension between an existing troffer and the ceiling support grid and resting the at least one fixed flat extension on the ceiling support grid;

pivoting the frame about the at least one fixed flat extension and placing the frame substantially within a plane of the ceiling support grid;

extending at least one retractable support outwardly from a second side of the frame and positioning the at least one retractable support between the troffer and the ceiling support grid; and resting the at least one retractable support on the ceiling support grid, and thereby holding the frame with the ceiling support grid and having the troffer rest directly on the at least one fixed extension and the at least one retractable support;

wherein the first side of the frame is parallel with the second side of the frame.

17. The method of claim 16 further comprising attaching a first side of an LED light source with one of the sides of the frame and attaching a second side of the LED light source with a parallel side of the frame.

18. The method of claim 17, wherein the step of attaching a first side of the LED light source with one of the sides of the frame comprises hingedly hanging the LED light source from one of the sides of the frame and the step of attaching a second side of the LED light source with a parallel side of the frame comprises pivoting the LED light source about the first side of the LED light source.

19. The method of claim 17, wherein the step of attaching a second side of the LED light source with the frame comprises clasping the second side of the LED light source to the frame.

* * * * *